US009536530B2

(12) United States Patent
Schnell et al.

(10) Patent No.: US 9,536,530 B2
(45) Date of Patent: Jan. 3, 2017

(54) INFORMATION SIGNAL REPRESENTATION USING LAPPED TRANSFORM

(71) Applicant: Fraunhofer-Gesellschaft zur Foerderung der angewandten Forschung e.V., Munich (DE)

(72) Inventors: Markus Schnell, Nuremberg (DE); Ralf Geiger, Erlangen (DE); Emmanuel Ravelli, Erlangen (DE); Eleni Fotopoulou, Nuremberg (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 634 days.

(21) Appl. No.: 13/672,935

(22) Filed: Nov. 9, 2012

(65) Prior Publication Data

US 2013/0064383 A1 Mar. 14, 2013

Related U.S. Application Data

(63) Continuation of application No. PCT/EP2012/052458, filed on Feb. 14, 2012.
(Continued)

(51) Int. Cl.
*G10L 19/00* (2013.01)
*G10L 19/02* (2013.01)
(Continued)

(52) U.S. Cl.
CPC ..... *G10L 19/00* (2013.01); *G10K 11/16* (2013.01); *G10L 19/005* (2013.01);
(Continued)

(58) Field of Classification Search
USPC ..... 704/500, E19.02, E19.011, E19.005, 704/E19.015, 219, E19.023, E19.04, 704/E19.041,704/204; 375/E7.226, 240, 375/240.03, 240.11; 381/123
See application file for complete search history.

(56) References Cited

U.S. PATENT DOCUMENTS 5,537,510 A 7/1996 Kim
5,598,506 A 1/1997 Wigren et al.
(Continued)

FOREIGN PATENT DOCUMENTS

AU 2007/312667 4/2008
CA 2730239 A1 1/2010
(Continued)

OTHER PUBLICATIONS

"Digital Cellular Telecommunications System (Phase 2+); Universal Mobile Telecommunications System (UMTS); LTE; Speech codec speech processing functions; Adaptive Multi-Rate-Wideband (AMR-)WB Speech Codec; Transcoding Functions (3GPP TS 26.190 version 9.0.0", Technical Specification, European Telecommunications Standards Institute (ETSI) 650, Route Des Lucioles; F-06921 Sophia-Antipolis; France; No. V.9.0.0, Jan. 1, 2012, 54 Pages.
(Continued)

*Primary Examiner* — Duc Nguyen
*Assistant Examiner* — Yogeshkumar Patel
(74) *Attorney, Agent, or Firm* — Michael A. Glenn; Perkins Coie LLP

(57) ABSTRACT

An information signal reconstructor is configured to reconstruct, using aliasing cancellation, an information signal from a lapped transform representation of the information signal including, for each of consecutive, overlapping regions of the information signal, a transform of a windowed version of the respective region, wherein the information signal reconstructor is configured to reconstruct the information signal at a sample rate which changes at a border
(Continued)

between a preceding region and a succeeding region of the information signal.

24 Claims, 8 Drawing Sheets

Related U.S. Application Data

(60) Provisional application No. 61/442,632, filed on Feb. 14, 2011.

(51) Int. Cl.

| | |
|---|---|
| ***G10L 19/04*** | (2013.01) |
| ***G10L 19/005*** | (2013.01) |
| ***G10L 19/12*** | (2013.01) |
| ***G10L 19/012*** | (2013.01) |
| ***G10K 11/16*** | (2006.01) |
| ***G10L 19/03*** | (2013.01) |
| ***G10L 19/22*** | (2013.01) |
| ***G10L 21/0216*** | (2013.01) |
| ***G10L 25/78*** | (2013.01) |
| *G10L 19/26* | (2013.01) |
| *G10L 25/06* | (2013.01) |
| *G10L 19/025* | (2013.01) |
| *G10L 19/107* | (2013.01) |

(52) U.S. Cl.

CPC ..... *G10L 19/012* (2013.01); *G10L 19/03* (2013.01); *G10L 19/12* (2013.01); *G10L 19/22* (2013.01); *G10L 21/0216* (2013.01); *G10L 25/78* (2013.01); *G10L 19/025* (2013.01); *G10L 19/0212* (2013.01); *G10L 19/04* (2013.01); *G10L 19/107* (2013.01); *G10L 19/26* (2013.01); *G10L 25/06* (2013.01)

(56) References Cited

U.S. PATENT DOCUMENTS 5,606,642 A 2/1997 Stautner et al.
5,684,920 A 11/1997 Iwakami et al.
5,727,119 A * 3/1998 Davidson ..... H04B 1/665 375/240
5,848,391 A * 12/1998 Bosi ..... H04B 1/665 704/200.1
5,890,106 A * 3/1999 Bosi-Goldberg .. H03H 17/0266 704/203
5,953,698 A 9/1999 Hayata
5,960,389 A 9/1999 Jarvinen et al.
6,070,137 A 5/2000 Bloebaum et al.
6,134,518 A 10/2000 Cohen et al.
6,173,257 B1 1/2001 Gao
6,236,960 B1 5/2001 Peng et al.
6,317,117 B1 11/2001 Goff
6,532,443 B1 3/2003 Nishiguchi et al.
6,587,817 B1 7/2003 Vähätalo et al.
6,636,829 B1 10/2003 Benyassine et al.
6,636,830 B1 * 10/2003 Princen ..... G10L 19/0212 704/204
6,680,972 B1 * 1/2004 Liljeryd ..... G10L 21/038 375/240
6,757,654 B1 6/2004 Westerlund et al.
6,879,955 B2 4/2005 Rao et al.
6,969,309 B2 11/2005 Carpenter
6,980,143 B2 * 12/2005 Linzmeier ..... H04B 1/66 341/143
7,003,448 B1 2/2006 Lauber et al.
7,124,079 B1 10/2006 Johansson et al.
7,249,014 B2 7/2007 Kannan et al.
7,280,959 B2 10/2007 Bessette
7,343,283 B2 3/2008 Ashley et al.
7,363,218 B2 4/2008 Jabri et al.
7,519,535 B2 4/2009 Spindola
7,519,538 B2 4/2009 Villemoes et al.
7,536,299 B2 5/2009 Cheng et al.
7,565,286 B2 7/2009 Gracie et al.
7,587,312 B2 9/2009 Kim
7,707,034 B2 4/2010 Sun et al.
7,711,563 B2 5/2010 Chen
7,788,105 B2 8/2010 Miseki
7,801,735 B2 * 9/2010 Thumpudi ..... G10L 19/032 704/201
7,809,556 B2 10/2010 Goto et al.
7,860,720 B2 * 12/2010 Thumpudi ..... G10L 19/008 704/200.1
7,873,511 B2 1/2011 Herre et al.
7,877,253 B2 1/2011 Krishnan et al.
7,917,369 B2 * 3/2011 Chen ..... G10L 19/02 704/200.1
7,930,171 B2 * 4/2011 Chen ..... G10L 19/008 704/200.1
7,933,769 B2 4/2011 Bessette
7,979,271 B2 7/2011 Bessette
7,987,089 B2 7/2011 Krishnan et al.
8,045,572 B1 10/2011 Li et al.
8,078,458 B2 12/2011 Zopf et al.
8,121,831 B2 2/2012 Oh et al.
8,160,274 B2 4/2012 Bongiovi
8,239,192 B2 8/2012 Kovesi et al.
8,255,207 B2 8/2012 Vaillancourt et al.
8,255,213 B2 8/2012 Yoshida et al.
8,364,472 B2 1/2013 Ehara
8,428,936 B2 4/2013 Mittal et al.
8,566,106 B2 10/2013 Salami et al.
8,630,862 B2 1/2014 Geiger et al.
8,630,863 B2 1/2014 Son et al.
8,825,496 B2 9/2014 Setiawan et al.
8,954,321 B1 2/2015 Beack et al.
2002/0111799 A1 8/2002 Bernard
2002/0176353 A1 * 11/2002 Atlas ..... G10L 19/02 370/203
2002/0184009 A1 12/2002 Heikkinen
2003/0009325 A1 1/2003 Kirchherr et al.
2003/0033136 A1 2/2003 Lee
2003/0046067 A1 3/2003 Gradl
2003/0078771 A1 4/2003 Jung et al.
2003/0225576 A1 12/2003 Li et al.
2004/0010329 A1 * 1/2004 Lee ..... G10L 19/16 700/94
2004/0093368 A1 5/2004 Lee et al.
2004/0184537 A1 * 9/2004 Geiger ..... G10L 19/032 375/240.11
2004/0220805 A1 * 11/2004 Geiger ..... G06F 17/147 704/230
2004/0225505 A1 11/2004 Andersen et al.
2005/0021338 A1 1/2005 Graboi et al.
2005/0065785 A1 3/2005 Bessette
2005/0080617 A1 * 4/2005 Koshy ..... G10L 19/0212 704/212
2005/0091044 A1 4/2005 Ramo et al.
2005/0096901 A1 5/2005 Uvliden et al.
2005/0130321 A1 6/2005 Nicholson et al.
2005/0131696 A1 6/2005 Wang et al.
2005/0154584 A1 7/2005 Jelinek et al.
2005/0165603 A1 7/2005 Bessette et al.
2005/0192798 A1 9/2005 Vainio et al.
2005/0240399 A1 10/2005 Makinen
2005/0278171 A1 12/2005 Suppappola et al.
2006/0095253 A1 * 5/2006 Schuller ..... G06T 1/0028 704/200.1
2006/0115171 A1 * 6/2006 Geiger ..... G06F 17/147 382/250
2006/0116872 A1 6/2006 Byun et al.
2006/0173675 A1 * 8/2006 Ojanpera ..... G10L 19/022 704/203
2006/0206334 A1 9/2006 Kapoor et al.
2006/0210180 A1 * 9/2006 Geiger ..... G10L 19/0017 382/232
2006/0271356 A1 11/2006 Vos
2006/0293885 A1 12/2006 Gournay et al.

(56) References Cited

U.S. PATENT DOCUMENTS

2007/0016404 A1 1/2007 Kim et al.
2007/0050189 A1 3/2007 Cruz-Zeno et al.
2007/0100607 A1* 5/2007 Villemoes ..... G10L 19/002 704/207
2007/0147518 A1 6/2007 Bessette
2007/0160218 A1 7/2007 Jakka et al.
2007/0171931 A1 7/2007 Manjunath et al.
2007/0172047 A1 7/2007 Coughlan et al.
2007/0196022 A1* 8/2007 Geiger ..... G06F 17/147 382/232
2007/0225971 A1 9/2007 Bessette
2007/0253577 A1 11/2007 Yen et al.
2007/0282603 A1 12/2007 Bessette
2008/0010064 A1 1/2008 Takeuchi et al.
2008/0015852 A1 1/2008 Kruger et al.
2008/0027719 A1 1/2008 Kirshnan et al.
2008/0046236 A1 2/2008 Thyssen et al.
2008/0052068 A1 2/2008 Aguilar et al.
2008/0097764 A1* 4/2008 Grill ..... G10L 19/0212 704/500
2008/0120116 A1* 5/2008 Schnell ..... G10L 19/025 704/500
2008/0147415 A1* 6/2008 Schnell ..... G10L 21/038 704/501
2008/0208599 A1 8/2008 Rosec et al.
2008/0221905 A1* 9/2008 Schnell ..... G10L 21/038 704/500
2008/0249765 A1* 10/2008 Schuijers ..... G10L 19/0212 704/203
2008/0275580 A1 11/2008 Andersen
2009/0024397 A1 1/2009 Ryu et al.
2009/0076807 A1 3/2009 Xu et al.
2009/0110208 A1 4/2009 Choo et al.
2009/0204412 A1 8/2009 Kovesi et al.
2009/0226016 A1 9/2009 Fitz et al.
2009/0228285 A1* 9/2009 Schnell ..... G10L 19/008 704/500
2009/0319283 A1* 12/2009 Schnell ..... G10L 19/0204 704/503
2009/0326930 A1 12/2009 Kawashima et al.
2010/0017200 A1 1/2010 Oshikiri et al.
2010/0017213 A1* 1/2010 Edler ..... G10L 19/26 704/500
2010/0063811 A1* 3/2010 Gao ..... G10L 19/025 704/230
2010/0063812 A1* 3/2010 Gao ..... G10L 19/0204 704/230
2010/0070270 A1 3/2010 Gao
2010/0106496 A1 4/2010 Morii et al.
2010/0138218 A1* 6/2010 Geiger ..... G10L 19/02 704/205
2010/0198586 A1* 8/2010 Edler ..... G10L 19/0212 704/203
2010/0217607 A1* 8/2010 Neuendorf ..... G10L 19/022 704/500
2010/0262420 A1* 10/2010 Herre ..... G10L 19/20 704/201
2010/0268542 A1 10/2010 Kim et al.
2011/0007827 A1 1/2011 Virette et al.
2011/0106542 A1* 5/2011 Bayer ..... G10L 19/167 704/500
2011/0153333 A1* 6/2011 Bessette ..... G10L 19/26 704/500
2011/0161088 A1 6/2011 Bayer et al.
2011/0173010 A1* 7/2011 Lecomte ..... G10L 19/20 704/500
2011/0173011 A1* 7/2011 Geiger ..... G10L 19/04 704/500
2011/0178795 A1* 7/2011 Bayer ..... G10L 19/002 704/205
2011/0218797 A1 9/2011 Mittal et al.
2011/0218799 A1 9/2011 Mittal et al.
2011/0218801 A1 9/2011 Vary et al.
2011/0257979 A1 10/2011 Gao
2011/0270616 A1 11/2011 Garudadri et al.
2011/0311058 A1 12/2011 Oh et al.
2012/0022881 A1 1/2012 Geiger et al.
2012/0226505 A1 9/2012 Lin et al.
2012/0271644 A1 10/2012 Bessette et al.
2013/0332151 A1 12/2013 Fuchs et al.

FOREIGN PATENT DOCUMENTS

CN 1274456 A 11/2000
CN 1344067 A 4/2002
CN 1381956 A 11/2002
CN 1437747 A 8/2003
CN 1539137 A 10/2004
CN 1539138 A 10/2004
CN 101351840 10/2006
CN 101110214 A 1/2008
CN 101366077 A 2/2009
CN 101371295 A 2/2009
CN 101379551 A 3/2009
CN 101388210 A 3/2009
CN 101425292 A 5/2009
CN 101483043 A 7/2009
CN 101488344 A 7/2009
CN 101743587 6/2010
CN 101770775 A 7/2010
DE 102008015702 A1 8/2009
EP 0665530 A1 8/1995
EP 0673566 A1 9/1995
EP 0758123 A2 2/1997
EP 0784846 A1 7/1997
EP 0843301 B1 5/1998
EP 1120775 A1 8/2001
EP 1852851 7/2007
EP 1845520 A1 10/2007
EP 2107556 7/2009
EP 2109098 A2 10/2009
EP 2144230 A1 1/2010
FR 2911228 A1 7/2008
JP H08263098 A 10/1996
JP 10039898 A 2/1998
JP H10214100 A 8/1998
JP H11502318 A 2/1999
JP H1198090 A 4/1999
JP 2000357000 A 12/2000
JP 2002-118517 4/2002
JP 2003501925 A 1/2003
JP 2003506764 A 2/2003
JP 2004513381 A 4/2004
JP 2004514182 A 5/2004
JP 2005534950 A 11/2005
JP 2006504123 A 2/2006
JP 2007065636 A 3/2007
JP 2007523388 A 8/2007
JP 2007525707 A 9/2007
JP 2007538282 A 12/2007
JP 2008-15281 1/2008
JP 2008513822 A 5/2008
JP 2008261904 A 10/2008
JP 2009508146 A 2/2009
JP 2009075536 A 4/2009
JP 2009522588 A 6/2009
JP 2009-527773 7/2009
JP 2010530084 A 9/2010
JP 2010-538314 12/2010
JP 2010539528 A 12/2010
JP 2011501511 A 1/2011
JP 2011527444 A 10/2011
KR 1020040043278 A 5/2004
KR 1020060025203 A 3/2006
KR 1020070088276 A 8/2007
KR 1020100059726 A 6/2010
KR 1020100134709 4/2015
RU 2169992 C2 6/2001
RU 2183034 C2 5/2002
RU 2003118444 A 12/2004
RU 2004138289 A 6/2005
RU 2296377 C2 3/2007

(56) References Cited

FOREIGN PATENT DOCUMENTS

| | | | |
|---|---|---|---|
| RU | 2302665 | C2 | 7/2007 |
| RU | 2312405 | C2 | 12/2007 |
| RU | 2331933 | C2 | 8/2008 |
| RU | 2335809 | C2 | 10/2008 |
| RU | 2008126699 | A | 2/2010 |
| RU | 2009107161 | A | 9/2010 |
| RU | 2009118384 | A | 11/2010 |
| TW | 200830277 | | 10/1996 |
| TW | 200943279 | | 10/1998 |
| TW | 201032218 | | 9/1999 |
| TW | 380246 | B | 1/2000 |
| TW | 469423 | B | 12/2001 |
| TW | I253057 | B | 4/2006 |
| TW | 200703234 | A | 1/2007 |
| TW | 200729156 | A | 8/2007 |
| TW | 200841743 | A | 10/2008 |
| TW | I313856 | B | 8/2009 |
| TW | 200943792 | A | 10/2009 |
| TW | I316225 | B | 10/2009 |
| TW | I 320172 | | 2/2010 |
| TW | 201009810 | A | 3/2010 |
| TW | 201009812 | A | 3/2010 |
| TW | I324762 | B | 5/2010 |
| TW | 201027517 | A | 7/2010 |
| TW | 201030735 | A | 8/2010 |
| TW | 201040943 | | 11/2010 |
| TW | I333643 | B | 11/2010 |
| TW | 201103009 | | 1/2011 |
| WO | 92/22891 | A1 | 12/1992 |
| WO | 95/10890 | A1 | 4/1995 |
| WO | 95/30222 | A1 | 11/1995 |
| WO | 96/29696 | A1 | 9/1996 |
| WO | 00/31719 | A2 | 6/2000 |
| WO | 0075919 | A1 | 12/2000 |
| WO | 02/101724 | A1 | 12/2002 |
| WO | WO-02101722 | | 12/2002 |
| WO | 2004027368 | A1 | 4/2004 |
| WO | 2005041169 | A2 | 5/2005 |
| WO | 2005078706 | A1 | 8/2005 |
| WO | 2005081231 | A1 | 9/2005 |
| WO | 2005112003 | A1 | 11/2005 |
| WO | 2006082636 | A1 | 8/2006 |
| WO | 2006126844 | A2 | 11/2006 |
| WO | WO-2007051548 | | 5/2007 |
| WO | 2007083931 | A1 | 7/2007 |
| WO | WO-2007073604 | | 7/2007 |
| WO | WO2007/096552 | | 8/2007 |
| WO | WO-2008013788 | | 10/2008 |
| WO | 2008/157296 | A1 | 12/2008 |
| WO | WO-2009029032 | | 3/2009 |
| WO | 2009077321 | A3 | 10/2009 |
| WO | WO2009/121499 | * | 10/2009 |
| WO | WO 2009/121499 | A1 * | 10/2009 |
| WO | 2010/003563 | A1 | 1/2010 |
| WO | 2010003491 | A1 | 1/2010 |
| WO | WO-2010/003491 | | 1/2010 |
| WO | WO-2010040522 | | 4/2010 |
| WO | 2010059374 | A1 | 5/2010 |
| WO | 2010081892 | A2 | 7/2010 |
| WO | 2010093224 | A2 | 8/2010 |
| WO | 2011/006369 | A1 | 1/2011 |
| WO | WO-2010003532 | | 2/2011 |
| WO | 2011/048117 | A1 | 4/2011 |
| WO | WO-2011048094 | | 4/2011 |
| WO | 2011/147950 | A1 | 12/2011 |

OTHER PUBLICATIONS

"IEEE Signal Processing Letters", IEEE Signgal Processing Society. vol. 15. ISSN 1070-9908., 2008, 9 Pages.

"Information Technology—MPEG Audio Technologies—Part 3: Unified Speech and Audio Coding", ISO/IEC JTC 1/SC 29 ISO/IEC DIS 23003-3, Feb. 9, 2011, 233 Pages.

"WD7 of USAC", International Organisation for Standardisation Organisation Internationale De Normailisation. ISO/IEC JTC1/SC29/WG11. Coding of Moving Pictures and Audio. Dresden, Germany., Apr. 2010, 148 Pages.

3GPP, "3rd Generation Partnership Project; Technical Specification Group Service and System Aspects. Audio Codec Processing Functions. Extended AMR Wideband Codec; Transcoding functions (Release 6).", 3GPP Draft; 26.290, V2.0.0 3rd Generation Partnership Project (3GPP), Mobile Competence Centre; Valbonne, France., Sep. 2004, 1-85.

Ashley, J et al., "Wideband Coding of Speech Using a Scalable Pulse Codebook", 2000 IEEE Speech Coding Proceedings., Sep. 17, 2000, 148-150.

Bessette, B et al., "The Adaptive Multirate Wideband Speech Codec (AMR-WB)", IEEE Transactions on Speech and Audio Processing, IEEE Service Center. New York. vol. 10, No. 8., Nov. 1, 2002, 620-636.

Bessette, B et al., "Universal Speech/Audio Coding Using Hybrid Acelp/Tcx Techniques", ICASSP 2005 Proceedings. IEEE International Conference on Acoustics, Speech, and Signal Processing, vol. 3 Jan. 1, 2005, 301-304.

Bessette, B et al., "Wideband Speech and Audio Codec at 16/24/32 Kbit/S Using Hybrid ACELP/TCX Techniques", 1999 IEEE Speech Coding Proceedings. Porvoo, Finland., Jun. 20, 1999, 7-9.

Ferreira, A et al., "Combined Spectral Envelope Normalization and Subtraction of Sinusoidal Components in the ODFTand MDCT Frequency Domains", 2001 IEEE Workshop on Applications of Signal Processing to Audio and Acoustics., 2001, 51-54.

Fischer, et al., "Enumeration Encoding and Decoding Algorithms for Pyramid Cubic Lattice and Trellis Codes", IEEE Transactions on Information Theory. IEEE Press, USA, vol. 41, No. 6, Part 2., Nov. 1, 1995, 2056-2061.

Hermansky, H et al., "Perceptual linear predictive (PLP) analysis of speech", J. Acoust. Soc. Amer. 87 (4)., 1990, 1738-1751.

Hofbauer, K et al., "Estimating Frequency and Amplitude of Sinusoids in Harmonic Signals—A Survey and the Use of Shifted Fourier Transforms", Graz: Graz University of Technology; Graz University of Music and Dramatic Arts., 2004.

Lanciani, C et al., "Subband-Domain Filtering of MPEG Audio Signals", 1999 IEEE International Conference on Acoustics, Speech, and Signal Processing. Phoenix, , AZ, USA., Mar. 15, 1999, 917-920.

Lauber, P et al., "Error Concealment for Compressed Digital Audio", Presented at the 111th AES Convention. Paper 5460. New York, USA., Sep. 21, 2001, 12 Pages.

Lee, Ick Don et al., "A Voice Activity Detection Algorithm for Communication Systems with Dynamically Varying Background Acoustic Noise", Dept. of Electical Engineering, 1998 IEEE.

Makinen, J et al., "AMR-WB+: a New Audio Coding Standard for 3rd Generation Mobile Audio Services", 2005 IEEE International Conference on Acoustics, Speech, and Signal Processing. Philadelphia, PA, USA., Mar. 18, 2005, 1109-1112.

Motlicek, P et al., "Audio Coding Based on Long Temporal Contexts", Rapport de recherche de I'IDIAP 06-30, Apr. 2006, 1-10.

Neuendorf, M et al., "A Novel Scheme for Low Bitrate Unified Speech Audio Coding—MPEG RMO", AES 126th Convention. Convention Paper 7713. Munich, Germany, May 1, 2009, 13 Pages.

Neuendorf, M et al., "Completion of Core Experiment on unification of USAC Windowing and Frame Transitions", International Organisation for Standardisation Organisation Internationale De Normalisation ISO/IEC JTC1/SC29/WG11. Coding of Moving Pictures and Audio. Kyoto, Japan., Jan. 2010, 52 Pages.

Neuendorf, M et al., "Unified Speech and Audio Coding Scheme for High Quality at Low Bitrates", ICASSP 2009 IEEE International Conference on Acoustics, Speech and Signal Processing. Psicataway, NJ, USA., Apr. 19, 2009, 4 Pages.

Patwardhan, P et al., "Effect of Voice Quality on Frequency-Warped Modeling of Vowel Spectra", Speech Communication. vol. 48, No. 8., 2006, 1009-1023.

Ryan, D et al., "Reflected Simplex Codebooks for Limited Feedback MIMO Beamforming", IEEE. XP31506379A., 2009, 6 Pages.

(56) References Cited

OTHER PUBLICATIONS

Sjoberg, J et al., "RTP Payload Format for the Extended Adaptive Multi-Rate Wideband (AMR-WB+) Audio Codec", Memo. The Internet Society. Network Working Group. Catagory: Standards Track., 2006, 1-38.
Terriberry, T et al., "A Multiply-Free Enumeration of Combinations with Replacement and Sign", IEEE Signal Processing Letters. vol. 15, 2008, 11 Pages.
Terriberry, T et al., "Pulse Vector Coding", Retrieved from the internet on Oct. 12, 2012. XP55025946. URL:http://people.xiph.org/~tterribe/pubs/cwrs.pdf, Dec. 1, 2007, 4 Pages.
Virette, D et al., "Enhanced Pulse Indexing CE for ACELP in USAC", Organisation Internationale De Normalisation ISO/IEC JTC1/SC29/WG11. MPEG2012/M19305. Coding of Moving Pictures and Audio. Daegu, Korea., Jan. 2011, 13 Pages.
Wang, F et al., "Frequency Domain Adaptive Postfiltering for Enhancement of Noisy Speech", Speech Communication 12. Elsevier Science Publishers. Amsterdam, North-Holland. vol. 12, No. 1., Mar. 1993, 41-56.
Waterschoot, T et al., "Comparison of Linear Prediction Models for Audio Signals", EURASIP Journal on Audio, Speech, and Music Processing. vol. 24., 2008.
Zernicki, T et al., "Report on CE on Improved Tonal Component Coding in eSBR", International Organisation for Standardisation Organisation Internationale De Normalisation ISO/IEC JTC1/SC29/WG11. Coding of Moving Pictures and Audio. Daegu, South Korea, Jan. 2011, 20 Pages.
Martin, R., Spectral Subtraction Based on Minimum Statistics, Proceedings of European Signal Processing Conference (EUSIPCO), Edinburg, Scotland, Great Britain, Sep. 1994, pp. 1182-1185.
A Silence Compression Scheme for G.729 Optimized for Terminals Conforming to Recommendation V.70, ITU-T Recommendation G.729—Annex B, International Telecommunication Union, Nov. 1996, pp. 1-16.
Herley, C. et al., "Tilings of the Time-Frequency Plane: Construction of Arbitrary Orthogonal Bases and Fast Tilings Algorithms", IEEE Transactions on Signal Processing , vol. 41, No. 12, Dec. 1993, pp. 3341-3359.
Lefebvre, R. et al., "High quality coding of wideband audio signals using transform coded excitation (TCX)", 1994 IEEE International Conference on Acoustics, Speech, and Signal Processing, Apr. 19-22, 1994, pp. I/193 to I/196 (4 pages).
3GPP, TS 26.290 Version 9.0.0; Digital cellular telecommunications system (Phase 2+); Universal Mobile Telecommunications System (UMTS); LTE; Audio codec processing functions; Extended Adaptive Multi-Rate-Wideband (AMR-WB+) codec; Transcoding functions (3GPP TS 26.290 version 9.0.0 release 9), Jan. 2010, Chapter 5.3, pp. 24-39.
Britanak, et al., "A new fast algorithm for the unified forward and inverse MDCT/MDST computation", Signal Processing, vol. 82, Mar. 2002, pp. 433-459.

* cited by examiner

INFORMATION SIGNAL REPRESENTATION USING LAPPED TRANSFORM

CROSS-REFERENCE TO RELATED APPLICATIONS

This application is a continuation of copending International Application No. PCT/EP2012/052458, filed Feb. 14, 2012, which is incorporated herein by reference in its entirety, and additionally claims priority from U.S. Patent Application No. 61/442,632, filed Feb. 14, 2011, which is also incorporated herein by reference in its entirety.

BACKGROUND OF THE INVENTION

The present application is concerned with information signal representation using lapped transforms and in particular the representation of an information signal using a lapped transform representation of the information signal necessitating aliasing cancellation such as used, for example, in audio compression techniques.

Most compression techniques are designed for a specific type of information signal and specific transmission conditions of the compressed data stream such as maximum allowed delay and available transmission bitrate. For example, in audio compression, transform based codecs such as AAC tend to outperform linear prediction based time-domain codecs such as ACELP, in case of higher available bitrate and in case of coding music instead of speech. The USAC codec, for example, seeks to cover a greater variety of application sceneries by unifying different audio coding principles within one codec. However, it would be favorable to further increase the adaptivity to different coding conditions such as varying available transmission bitrate in order to be able to take advantage thereof, so as to achieve, for example, a higher coding efficiency or the like.

SUMMARY

According to an embodiment, an information signal reconstructor configured to reconstruct, using aliasing cancellation, an information signal from a lapped transform representation of the information signal having, for each of consecutive, overlapping regions of the information signal, a transform of a windowed version of the respective region, wherein the information signal reconstructor is configured to reconstruct the information signal at a sample rate which changes at a border between a preceding region and a succeeding region of the information signal, may have: a retransformer configured to apply a retransformation on the transform of the windowed version of the preceding region so as to obtain a retransform for the preceding region, and apply a retransformation on the transform of the windowed version of the succeeding region so as to obtain a retransform for the succeeding region, wherein the retransform for the preceding region and the retransform for the succeeding region overlap at an aliasing cancellation portion at the border between the preceding and succeeding regions; a resampler configured to resample, by interpolation, the retransform for preceding region and/or the retransform for the succeeding region at the aliasing cancellation portion according to a sample rate change at the border; and a combiner configured to perform aliasing cancellation between the retransforms for the preceding and succeeding regions as obtained by the resampling at the aliasing cancellation portion.

Another embodiment may have a resampler composed of a concatenation of a filterbank for providing a lapped transform representation of an information signal, and an inverse filterbank having an information signal reconstructor configured to reconstruct, using aliasing cancellation, the information signal from the lapped transform representation of the information signal.

Another embodiment may have an information signal encoder having an inventive resampler and a compression stage configured to compress the reconstructed information signal, the information signal encoder further having a sample rate control configured to control the control signal depending on an external information on available transmission bitrate.

Another embodiment may have an information signal reconstructor having a decompressor configured to reconstruct a lapped transform representation of an information signal from a data stream, and an inventive information signal reconstructor configured to reconstruct, using aliasing cancellation, the information signal from the lapped transform representation.

According to another embodiment, an information signal transformer configured to generate a lapped transform representation of an information signal using an aliasing-causing lapped transform may have: an input for receiving the information signal in the form of a sequence of samples; a grabber configured to grab consecutive, overlapping regions of the information signal; a resampler configured to apply, by interpolation, a resampling onto at least a subset of the consecutive, overlapping regions of the information signals so that each of the consecutive, overlapping portions has a respective constant sample rate, but the respective constant sample rate varies among the consecutive, overlapping regions; a windower configured to apply a windowing on the consecutive, overlapping regions of the information signal; and a transformer configured to individually apply a transform on the windowed regions.

According to another embodiment, a method for reconstructing, using aliasing cancellation, an information signal from a lapped transform representation of the information signal having, for each of consecutive, overlapping regions of the information signal, a transform of a windowed version of the respective region, wherein the information signal reconstructor is configured to reconstruct the information signal at a sample rate which changes at a border between a preceding region and a succeeding region of the information signal, may have the steps of: applying a retransformation on the transform of the windowed version of the preceding region so as to obtain a retransform for the preceding region, and apply a retransformation on the transform of the windowed version of the succeeding region so as to obtain a retransform for the succeeding region, wherein the retransform for the preceding region and the retransform for the succeeding region overlap at an aliasing cancellation portion at the border between the preceding and succeeding regions; resampling, by interpolation, the retransform for preceding region and/or the retransform for the succeeding region at the aliasing cancellation portion according to a sample rate change at the border; and performing aliasing cancellation between the retransforms for the preceding and succeeding regions as obtained by the resampling at the aliasing cancellation portion.

According to another embodiment, a method for generating a lapped transform representation of an information signal using an aliasing-causing lapped transform may have the steps of: receiving the information signal in the form of a sequence of samples; grabbing consecutive, overlapping regions of the information signal; applying, by interpolation, a resampling onto at least a subset of the consecutive, overlapping regions of the information signals so that each of the consecutive, overlapping portions has a respective constant sample rate, but the respective constant sample rate varies among the consecutive, overlapping regions; applying a windowing on the consecutive, overlapping regions of the information signal; and individually applying a transformation on the windowed regions.

Another embodiment may have a computer program having a program code for performing, when running on a computer, an inventive method.

The main thoughts which lead to the present invention are the following. Lapped transform representations of information signals are often used in order to form a pre-state in efficiently coding the information signal in terms of, for example, rate/distortion ratio sense. Examples of such codecs are AAC or TCX or the like. Lapped transform representations may, however, also be used to perform re-sampling by concatenating transform and re-transform with different spectral resolutions. Generally, lapped transform representations causing aliasing at the overlapping portions of the individual retransforms of the transforms of the windowed versions of consecutive time regions of the information signal have an advantage in terms of the lower number of transform coefficient levels to be coded so as to represent the lapped transform representation. In an extreme form, lapped transforms are "critically sampled". That is, do not increase the number of coefficients in the lapped transform representation compared to the number of time sample of the information signal. An example of a lapped transform representation is an MDCT (Modified Discrete Cosine Transform) or QMF (Quadratur Mirror Filters) filterbank. Accordingly, it is often favorable to use such a lapped transform representations as a pre-state in efficiently coding information signals. However, it would also be favorable to be able to allow the sample rate at which the information signal is represented using the lapped transform representation to change in time so as to be adapted, for example, to the available transmission bitrate or other environmental conditions. Imagine a varying available transmission bitrate. Whenever the available transmission bitrate falls below some predetermined threshold, for example, it may be favorable to lower the sample rate, and when the available transmission rate raises again it would be favorable to be able to increase the sample rate at which the lapped transform representation represents the information signal. Unfortunately, the overlapping aliasing portions of the retransforms of the lapped transform representation seem to form a bar against such sample rate changes, which bar seems to be overcome only by completely interrupting the lapped transform representation at instances of sample rate changes. The inventors of the present invention, however, realized a solution to the above-outlined problem, thereby enabling an efficient use of lapped transform representations involving aliasing and the sample rate variation in concern. In particular, by interpolation, the preceding and/or succeeding region of the information signal is resampled at the aliasing cancellation portion according to the sample rate change at the border between both regions. A combiner is then able to perform the aliasing cancellation at the border between the retransforms for the preceding and succeeding regions as obtained by the resampling at the aliasing cancellation portion. By this measure, sampling rate changes are efficiently traversed with avoiding any discontinuity of the lapped transform representation at the sample rate changes/transitions. Similar measures are also feasible at the transform side so as to appropriately generate a lapped transform.

Using the idea just outlined, it is possible to provide information signal compression techniques, such as audio compression techniques, which have high coding efficiency over a wide range of environmental coding conditions such as available transmission bandwidth by adapting the conveyed sample rate to these conditions with no penalty by the sample rate change instances themselves.

BRIEF DESCRIPTION OF THE DRAWINGS

Embodiments of the present invention will be detailed subsequently referring to the appended drawings, in which.

DETAILED DESCRIPTION OF THE INVENTION

In order to motivate the embodiments of the present invention further described below, preliminarily, embodiments are discussed within which embodiments of the present application may be used, and which render the intention and the advantages of the embodiments of the present application outlined further below clear.

Figure 1A:
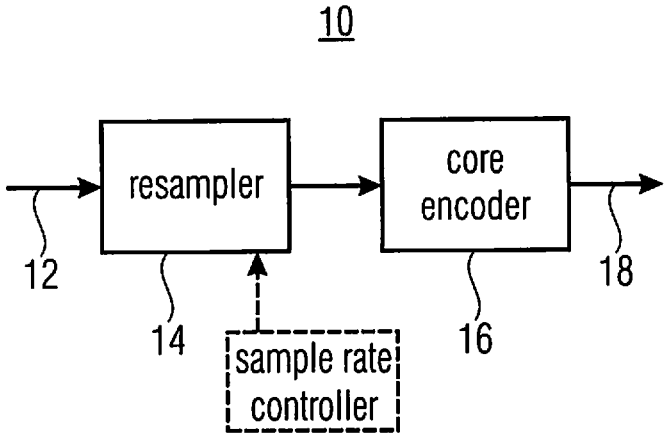
FIG. 1*a* shows a block diagram of an information encoder where embodiments of the present invention could be implemented.
Figure 1B:
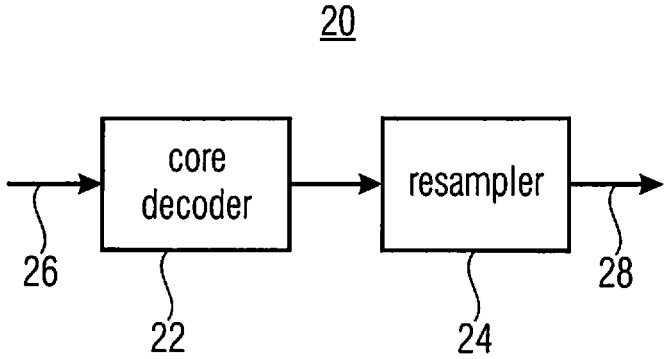
FIG. 1*b* shows a block diagram of an information signal decoder where embodiments of the present invention could be implemented.

FIGS. 1*a* and 1*b* show, for example, a pair of an encoder and a decoder where the subsequently explained embodiments may be advantageously used. FIG. 1*a* shows the encoder while FIG. 1*b* shows the decoder. The information signal encoder 10 of FIG. 1*a* comprises an input 12 at which the information signal enters, a resampler 14 and a core encoder 16, wherein the resampler 14 and the core encoder 16 are serially connected between the input 12 and an output 18 of encoder 10. At the output 18 encoder 10 outputs the data stream representing the information signal of input 12. Likewise, the decoder shown in FIG. 1*b* with reference sign 20 comprises a core decoder 22 and a resampler 24 which are serially connected between an input 26 and an output 28 of decoder 20 in the manner shown in FIG. 1*b*.

If the available transmission bitrate for conveying the data stream output at output 18 to the input 26 of decoder 20 is high, it may in terms of coding efficiency be favorable to represent the information signal 12 within the data stream at a high sample rate, thereby covering a wide spectral band of the information signal's spectrum. That is, a coding efficiency measure such as a rate/distortion ratio measure may reveal that a coding efficiency is higher if the core encoder 16 compresses the input signal 12 at a higher sample rate when compared to a compression of a lower sample rate version of information signal 12. On the other hand, at lower available transmission bitrates, it may occur that the coding efficiency measure is higher when coding the information signal 12 at a lower sample rate. In this regard, it should be noted that the distortion may be measured in a psychoacoustically motivated manner, i.e. with taking distortions within perceptually more relevant frequency regions into account more intensively than within perceptually less relevant frequency regions, i.e. frequency regions where the human ear is, for example, less sensitive. Generally, low frequency regions tend to be more relevant than higher frequency regions, and accordingly lower sample rate coding excludes frequency components of the signal at input 12, lying above the Nyquist frequency from being coded, but on the other hand, the bit rate saving resulting therefrom may, in rate/distortion rate sense, result in this lower sample rate coding that is advantageous over higher sample rate coding. Similar discrepancies in the significance of distortions between lower and higher frequency portions also exist in other information signals such as measurement signals or the like.

Accordingly, resampler 14 is for varying the sample rate at which information signal 12 is sampled. By appropriately controlling the sample rate in dependency on the external transmission conditions such as defined, inter alias, by the available transmission bitrate between output 18 and input 26, encoder 10 is able to achieve an increased coding efficiency despite the external transmission condition changing over time. The decoder 20, in turn, comprises core decoder 22 which decompresses the data stream, wherein the resampler 24 takes care that the reconstructed information signal output at output 28 has a constant sample rate again.

Figure 2A:
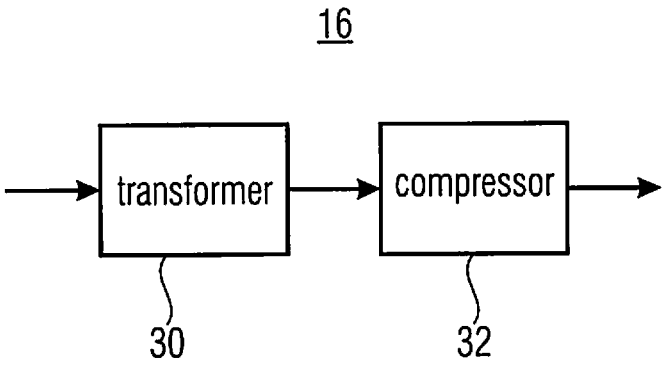
FIG. 2*a* shows a block diagram of a possible internal structure of the core encoder of FIG. 1*a;*
Figure 2B:
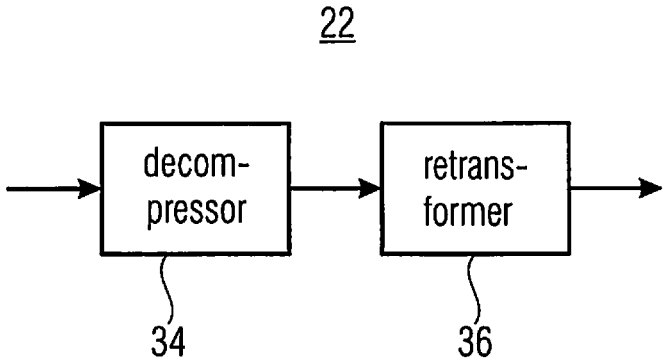
FIG. 2*b* shows a block diagram of a possible internal structure of the core decoder of FIG. 1*b;*

However, problems result whenever a lapped transform representation is used in the encoder/decoder pair of FIGS. 1*a* and 1*b*. A lapped transform representation involving aliasing at the overlapping regions of the retransforms form an effective tool for coding, but due to the necessitated time aliasing cancellation, problems occur if the sample rate changes. See, for example, FIGS. 2*a* and 2*b*. FIGS. 2*a* and 2*b* show possible implementations for core encoder 16 and core decoder 22 assuming that both are of the transform coding type. Accordingly, the core encoder 16 comprises a transformer 30 followed by a compressor 32 and the core decoder shown in FIG. 2*b* comprises a decompressor 34 followed, in turn, by a retransformer 36. FIGS. 2*a* and 2*b* shall not be interpreted to the extent that no other modules could be present within core encoder 16 and core decoder 22. For example, a filter could precede transformer 30 so that the latter would transform the resampled information signal obtained by resampler 14 not directly, but in a pre-filtered form. Similarly, a filter having an inverse transfer function could succeed retransformer 36 so that the retransform signal could be inversely filtered subsequently.

The compressor 32 would compress the resulting lapped transform representation output by transformer 30, such as by use of lossless coding such as entropy coding including examples like Huffman or arithmetic coding, and the decompressor 34 could do the inverse process, i.e. decompressing, by, for example, entropy decoding such as Huffman or arithmetic decoding to obtain the lapped transform representation which is then fed to retransformer 36.

In the transform coding environment shown in FIGS. 2*a* and 2*b*, problems occur whenever resampler 14 changes the sampling rate. The problem is less severe at the encoding side as the information signal 12 is present anyway and accordingly, the transformer 30 could be provided with continuously sampled regions for the individual transformations using a windowed version of the respective regions even across instances of a sampling rate change. A possible embodiment for implementing transformer 30 accordingly, is described in the following with respect to FIG. 6. Generally, the transformer 30 could be provided with a windowed version of a preceding region of the information signal in a current sampling rate, with then feeding transformer 30 by resampler 14 with a next, partially overlapping region of the information signal, the transform of the windowed version of which is then generated by transformer 30. No additional problem occurs since the necessitated time aliasing cancellation needs to be done at the retransformer 36 rather than the transformer 30. At the retransformer 36, however, the change in sampling rate causes problems in that the retransformer 36 is not able to perform the time aliasing cancellation as the retransforms of the afore-mentioned immediately following regions relate to different sampling rates. The embodiments described further below overcome these problems. The retransformer 36 may, according to these embodiments, be replaced by an information signal reconstructor further described below.

Figure 3A:
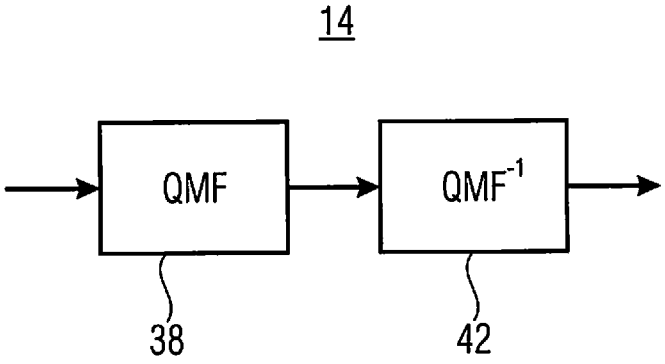
FIG. 3*a* shows a block diagram of a possible implementation of the resampler of FIG. 1*a;*
Figure 3B:
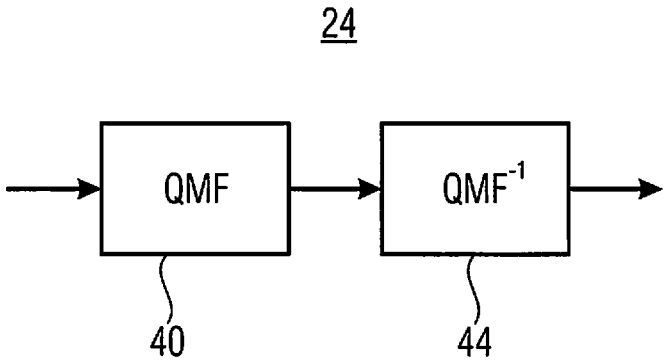
FIG. 3*b* shows a block diagram of a possible internal structure of the resampler of FIG. 1*b;*

However, in the environment described with respect to FIGS. 1*a* and 1*b*, problems do not only occur in the case of the core encoder 16 and the core decoder 22 being of the transform coding type. Rather, problems may also occur in the case of using lapped transform based filterbanks for forming the resamplers 14 and 24, respectively. See, for example, FIGS. 3*a* and 3*b*. FIGS. 3*a* and 3*b* show one specific embodiment for realizing resamplers 14 and 24. In accordance with the embodiment of FIGS. 3*a* and 3*b*, both resamplers are implemented by using a concatenation of analysis filterbanks 38 and 40, respectively, followed by synthesis filterbanks 32 and 44, respectively. As illustrated in FIGS. 3*a* and 3*b*, analysis and synthesis filterbanks 38 to 44 may be implemented as QMF filterbanks, i.e. MDCT based filterbanks using QMF for splitting the information signal beforehand, and re-joining the signal again. The QMF may be implemented similar to the QMF used in the SBR part of MPEG HE-AAC or AAC-ELD meaning a multi-channel modulated filter bank with an overlap of 10 blocks, wherein 10 is just an example. Thus, a lapped transform representation is generated by the analysis filterbanks 38 and 40, and the re-sampled signal is reconstructed from this lapped transform representation in case of the synthesis filterbanks 42 and 44. In order to yield a sampling rate change, synthesis filterbank 42 and analysis filterbank 40 may be implemented to operate at varying transform length, wherein however the filterbank or QMF rate, i.e. the rate at which the consecutive transforms are generated by analysis filterbanks 38 and 40, respectively, on the one hand and retransformed by synthesis filterbanks 42 and 44, respectively, on the other hand, is constant and the same for all components 38 to 44. Changing the transform length, however, results in a sampling rate change. Consider, for example, the pair of analysis filterbank 38 and synthesis filterbank 42. Assume that the analysis filterbank 38 operates using a constant transform length and a constant filterbank or transform rate. In this case, the lapped transform representation of the input signal output by analysis filterbank 38 comprises for each of consecutive, overlapping regions of the input signal, having constant sample length, a transform of a windowed version of the respective region, the transforms also having a constant length. In other words, the analysis filterbank 38 would forward to synthesis filterbank 42 a spectrogram of a constant time/frequency resolution. The synthesis filterbank's transform length, however, would change. Consider, for example, the case of downsampling from a first downsampling rate between input sample rate at the input of analysis filterbank 38 and the sampling rate of the signal output at the output of synthesis filterbank 42, to a second downsampling rate. As long as the first downsampling rate is valid, the lapped transform representation or spectrogram output by the analysis filterbank 38 would merely partially be used to feed the retransformations within the synthesis filterbank 42. The retransformation of the synthesis filterbank 42 would simply be applied to the lower frequency portion of the consecutive transforms within the spectrogram of analysis filterbank 38. Due to the lower transform length used in the retransformation of the synthesis filterbank 42, the number of samples within the retransforms of the synthesis filterbank 42 would also be lower than compared to the number of samples having been subject, in clusters of the overlapping time portions, to transformations in the filterbank 38, thereby resulting in a lower sampling rate when compared to the original sampling rate of the information signal entering the input of the analysis filterbank 38. No problems, would occur as long as the downsampling rate stays the same as it is still no problem for the synthesis filterbank 42 to perform the time aliasing cancellation at the overlap between the consecutive retransforms and the consecutive, overlapping regions of the output signal at the output of filterbank 42.

The problem occurs whenever a change in the downsampling rate occurs such as the change from a first downsampling rate to a second, greater downsampling rate. In this case, the transform length used within the retransformation of the synthesis filterbank 42 would be further reduced, thereby resulting in an even lower sampling rate for the respective subsequent regions after the sampling rate change point in time. Again, problems occur for the synthesis filterbank 42 as the time aliasing cancellation between the retransform concerning the region immediately preceding the sample rate change point in time and the retransform concerning the region of the resampled signal immediately succeeding the sample rate change point in time, disturbs the time aliasing cancellation between the retransforms in question. Accordingly, it does not help very much that similar problems do not occur at the decoding side where the analysis filterbank 40 with a varying transform length precedes the synthesis filterbank 44 of constant transform length. Here, the synthesis filterbank 44 applies to the spectrogram of constant QMF/transform rate, but of different frequency resolution, i.e. the consecutive transforms forwarded from the analysis filterbank 40 to synthesis filterbank 44 at a constant rate but with a different or time-varying transform length to preserve the lower-frequency portion of the entire transform length of the synthesis filterbank 44 with padding the higher frequency portion of the entire transform length with zeros. The time aliasing cancellation between the consecutive retransforms output by the synthesis filterbank 44 is not problematic as the sampling rate of the reconstructed signal output at the output of synthesis filterbank 44 has a constant sample rate.

Thus, again there is a problem in trying to realize the sample rate variation/adaption presented above with respect to FIGS. 1*a* and 1*b*, but these problems may be overcome by implementing the inverse or synthesis filterbank 42 of FIG. 3*a* in accordance with some of the subsequently explained embodiments for an information signal reconstructor.

Figure 4A:
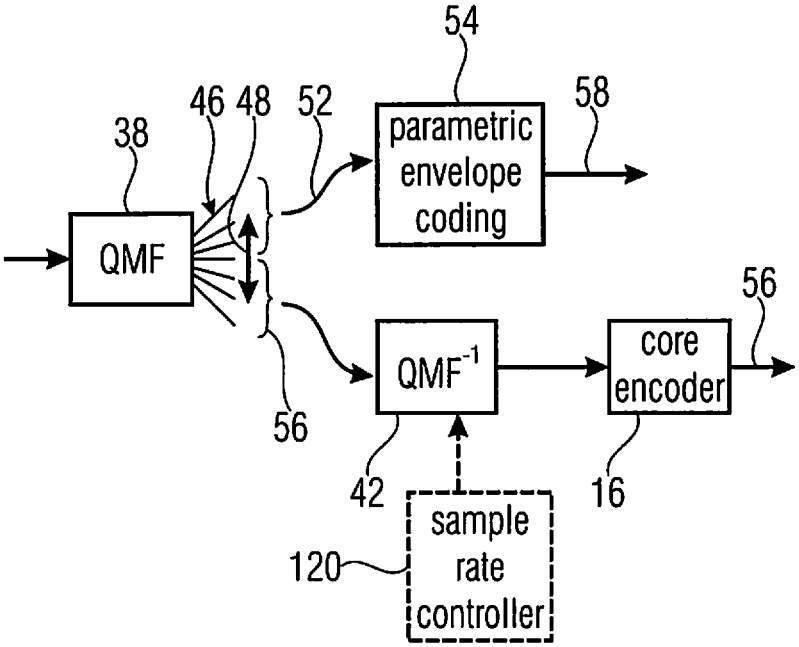
FIG. 4*a* shows a block diagram of an information signal encoder where embodiments of the present invention could be implemented.
Figure 4B:
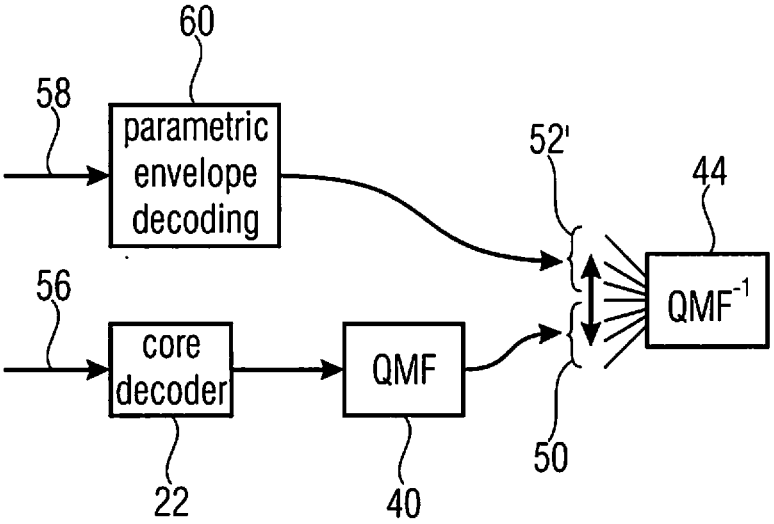
FIG. 4*b* shows a block diagram of an information signal decoder where embodiments of the present invention could be implemented.

The above thoughts with regard to a sampling rate adaption/variation are even more interesting when considering coding concepts according to which a higher frequency portion of an information signal to be coded is coded in a parametric way, e.g. by using Spectral Band Replication (SBR), whereas a lower frequency portion thereof is coded using transform coding and/or predictive coding or the like. See, for example, FIGS. 4*a* and 4*b* showing a pair of information signal encoder and information signal decoder. At the encoding side, the core encoder 16 succeeds a resampler embodied as shown in FIG. 3*a*, i.e. a concatenation of an analysis filterbank 38 and a varying transform length synthesis filterbank 42. As noted above, in order to achieve a time-varying downsample rate between the input of analysis filterbank 38 and the output of synthesis filterbank 42, the synthesis filterbank 42 applies its retransformation onto a subportion of the constant range spectrum, i.e. the transforms of constant length and constant transform rate 46, output by the analysis filterbank 38, of which the subportions have the time-varying length of the transform length of the synthesis filterbank 42. The time variation is illustrated by the double-headed arrow 48. While the lower frequency portion 50 resampled by the concatenation of analysis filterbank 38 and synthesis filterbank 42 is encoded by core encoder 16, the remainder, i.e. the higher frequency portion 52 making up the remaining frequency portion of spectrum 46, may be subject to a parametric coding of its envelope in parametric envelope coder 54. The core data stream 56 is thus accompanied by a parametric coding data stream 58 output by a parametric envelope coder 54.

At the decoding side, the decoder likewise comprises core decoder 22, followed by a resampler implemented as shown in FIG. 3*b*, i.e. by an analysis filterbank 40 followed by a synthesis filterbank 44, with the analysis filterbank 40 having a time-varying transform length synchronized to the time variation of the transform length of the synthesis filterbank 42 at the encoding side. While core decoder 22 receives the core data stream 56 in order to decode same, a parametric envelope decoder 60 is provided in order to receive the parametric data stream 58 and derive therefrom a higher frequency portion 52', complementing a lower frequency portion 50 of a varying transform length, namely a length synchronized to the time variation of the transform length used by the synthesis filterbank 42 at the encoding side and synchronized to the variation of the sampling rate output by core decoder 22.

In the case of the encoder of FIG. 4*a*, it is advantageous that the analysis filterbank 38 is present anyway so that the formation of the resampler merely necessitates the addition of the synthesis filterbank 42. By switching the sample rate, it is possible to adapt the ratio of LF portion of the spectrum 46, which is subject to a more accurate core encoding compared to the HF portion which is subject to merely parametric envelope coding. In particular, the ratio may be controlled in an efficient way depending on external conditions such as available transmission bandwidth for transmitting the overall data stream or the like. The time variation controlled at the encoding side is easy to signalize to the decoding side via respective side information data, for example.

Figure 5:
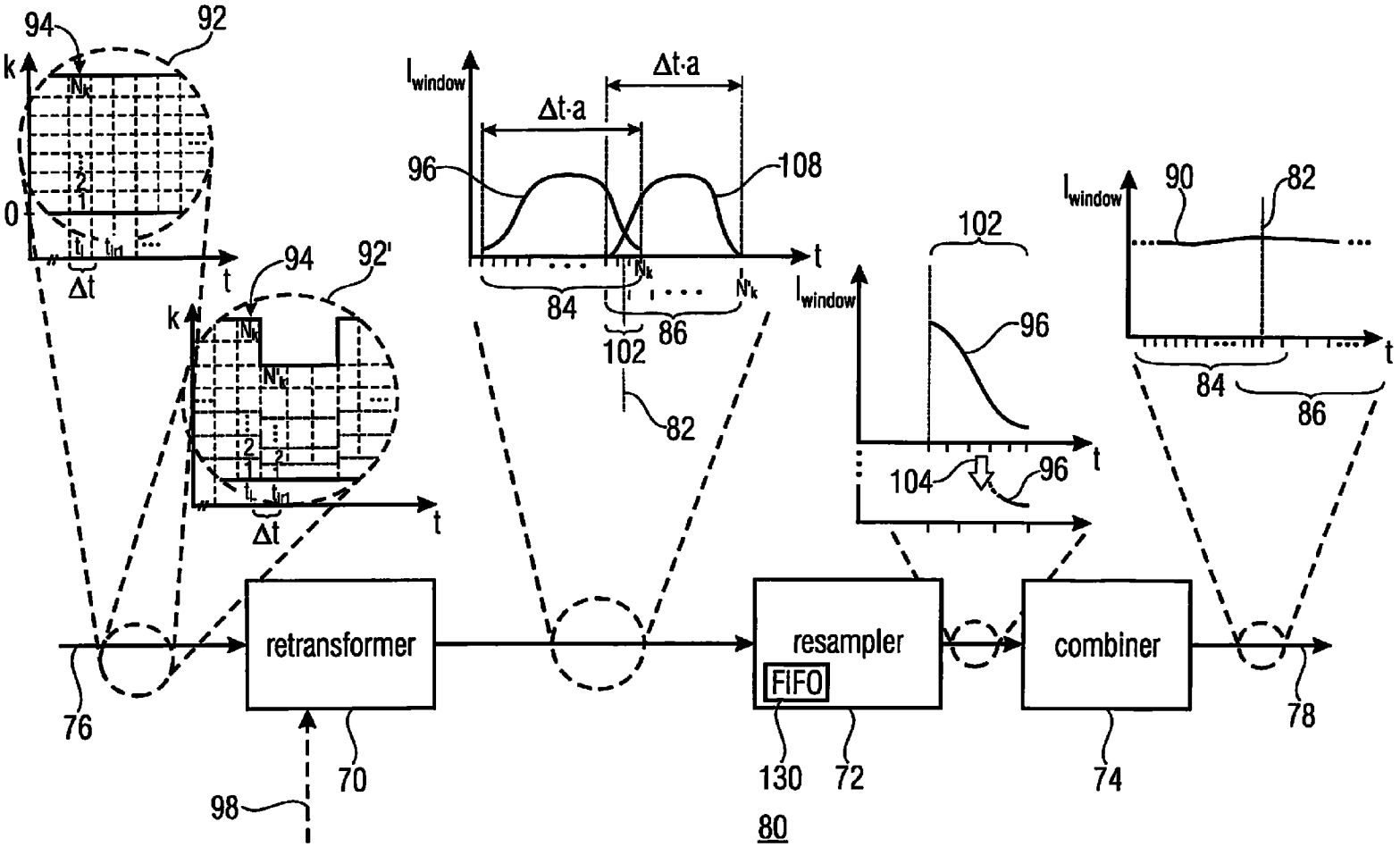
FIG. 5 shows a block diagram of an information signal reconstructor in accordance with an embodiment.

Thus, with respect to FIGS. 1*a* to 4*b* it has been shown that it would be favorable if one would have a concept at hand which effectively enables a sampling rate change despite the use of lapped transform representations necessitating time aliasing cancellation. FIG. 5 shows an embodiment of an information signal reconstructor which would, if used for implementing the synthesis filterbank 42 or the retransformer 36 in FIG. 2*b*, overcome the problems outlined above and achieve the advantages of exploiting the advantages of such a sample rate change as outlined above.

The information signal reconstructor shown in FIG. 5 comprises a retransformer 70, a resampler 72 and a combiner 74, which are serially connected in the order of their mentioning between an input 76 and an output 78 of information signal reconstructor 80.

The information signal reconstructor shown in FIG. 5 is for reconstructing, using aliasing cancellation, an information signal from a lapped transform representation of the information signal entering at input 76. That is, the information signal reconstructor is for outputting at output 78 the information signal at a time-varying sample rate using the lapped transform representation of this information signal as entering input 76. The lapped transform representation of the information signal comprises, for each of consecutive, overlapping time regions (or time intervals) of the information signal, a transform of a windowed version of the respective region. As will be outlined in more detail below, the information signal reconstructor 80 is configured to reconstruct the information signal at a sample rate which changes at a border 82 between a preceding region 84 and a succeeding region 86 of the information signal 90.

In order to explain the functionality of the individual modules 70 to 74 of information signal reconstructor 80, it is preliminarily assumed that the lapped transform representation of the information signal entering at input 76 has a constant time/frequency resolution, i.e. a resolution constant in time and frequency. Later-on another scenario is discussed.

According to the just-mentioned assumption, the lapped transform representation could be thought of as shown at 92 in FIG. 5. As is shown, the lapped transform representation comprises a sequence of transforms which are consecutive in time with a certain transform rate Δt. Each transform 94 represents a transform of a windowed version of a respective time region i of the information signal. In particular, as the frequency resolution is constant in time for representation 92, each transform 94 comprises a constant number of transform coefficients, namely $N_k$. This effectively means that the representation 92 is a spectrogram of the information signal comprising $N_k$ spectral components or subbands which may be strictly ordered along a spectral axis k as illustrated in FIG. 5. In each spectral component or subband, the transform coefficients within the spectrogram occur at the transform rate Δt.

A lapped transform representation 92 having such a constant time/frequency resolution is, for example, output by a QMF analysis filterbank as shown in FIG. 3*a*. In this case, each transform coefficient would be complex valued, i.e. each transform coefficient would have a real and an imaginary part, for example. However, the transform coefficients of the lapped transform representation 92 are not necessarily complex valued, but could also be solely real valued, such as in the case of a pure MDCT. Besides this, it is noted that the embodiment of FIG. 5 would also be transferable onto other lapped transform representations causing aliasing at the overlapping portions of the time regions, the transforms 94 of which are consecutively arranged within the lapped transform representation 92.

The retransformer 70 is configured to apply a retransformation on the transforms 94 so as to obtain, for each transform 94, a retransform illustrated by a respective time envelope 96 for consecutive time regions 84 and 86, the time envelope roughly corresponding to the window applied to the afore-mentioned time portions of the information signal in order to yield the sequence of transforms 94. As far as the preceding time region 84 is concerned, FIG. 5 assumes that the retransformer 70 has applied the retransformation onto the full transform 94 associated with that region 84 in the lapped transform representation 92 so that the retransform 96 for region 84 comprises, for example, $N_k$ samples or two times $N_k$ samples—in any case, as many samples as made up the windowed portion from which the respective transform 94 was obtained—sampling the full temporal length Δt·a of time region 84 with the factor a being a factor determining the overlap between the consecutive time regions in units of which the transforms 94 of representation 92 have been generated. It should be noted here that the equality (or duplicity) of the number of time samples within time region 84 and the number of transform coefficients within transform 94 belonging to that time region 84 has merely been chosen for illustration purposes and that the equality (or duplicity) may be also be replaced by another constant ratio between both numbers in accordance with an alternative embodiment, depending on the detailed lapped transform used.

It is now assumed that the information signal reconstructor seeks to change the sample rate of the information signal between time region 84 and time region 86. The motivation to do so may stem from an external signal 98. If, for example, the information signal reconstructor 80 is used for implementing the synthesis filterbank 42 of FIG. 3*a* and FIG. 4*a*, respectively, the signal 98 may be provided whenever a sample rate change promises a more efficient coding, such as the course of a change in the transmission conditions of the data stream.

In the present case, it is for illustration purposes assumed that the information signal reconstructor 80 seeks to reduce the sample rate between time regions 84 and 86. Accordingly, retransformer 70 also applies a retransformation on the transform of the windowed version of the succeeding region 86 so as to obtain the retransform 100 for the succeeding region 86, but this time the retransformer 70 uses a lower transform length for performing the retransformation. To be more precise, retransformer 70 performs the retransformation onto the lowest $N_k' < N_k$ of the transform coefficients of the transform for the succeeding region 86 only, i.e. transform coefficients 1 . . . $N_k'$, so that the retransform 100 obtained comprises a lower sample rate, i.e. it is sampled with merely $N_k'$ instead of $N_k$ (or a corresponding fraction of the latter number).

As is illustrated in FIG. 5, the problem occurring between retransforms 96 and 100 is the following. The retransform 96 for the preceding region 84 and the retransform 100 for the succeeding region 86 overlap at an aliasing cancellation portion 102 at a border 82 between the preceding and succeeding regions 84 and 86, with the time length of the aliasing cancellation portion being, for example, (a−1)·Δt, but the number of samples of the retransform 96 within this aliasing cancellation portion 102 is different from (in this very example, is higher than) the number of samples of retransform 100 within the same aliasing cancellation portion 102. Thus, the time aliasing cancellation by performing overlap-adding both retransforms 96 and 100 in that time interval 102 is not straight forward.

Accordingly, resampler 72 is connected between retransformer 70 and combiner 74, the latter one of which is responsible for performing the time aliasing cancellation. In particular, the resampler 72 is configured to resample, by interpolation, the retransform 96 for the preceding region 84 and/or the retransform 100 for the succeeding region 86 at the aliasing cancellation portion 102 according to the sample rate change at the border 82. As the retransform 96 reaches the input of resampler 72 earlier than retransform 100, it may be advantageous that resampler 72 performs the resampling onto the retransform 96 for the preceding region 84. That is, by interpolation 104, the corresponding portion of the retransform 96 as contained within aliasing cancellation portion 102 would be resampled so as to correspond to the sampling condition or sample positions of retransform 100 within the same aliasing cancellation portion 102. The combiner 74 may then simply add co-located samples from the re-sampled version of retransform 96 and the retransform 100 in order to obtain the reconstructed signal 90 within that time interval 102 at the new sample rate. In that case, the sample rate in the output reconstructed signal would switch from the former to the new sample rate at the leading end (beginning) of time portion 86. However, the interpolation could also be applied differently for a leading and trailing half of time interval 102 so as to achieve another point 82 in time for the sample rate switch in the reconstructed signal 90. Thus, time instant 82 has been drawn in FIG. 5 to be in the mid of the overlap between portion 84 and 86 merely for illustration purposes and in accordance with other embodiments same point in time may lie somewhere else between the beginning of portion 86 and the end of portion 84, both inclusively.

Accordingly, the combiner 74 is then able to perform the aliasing cancellation between the retransforms 96 and 100 for the preceding and succeeding regions 84 and 86, respectively, as obtained by the resampling at the aliasing cancellation portion 102. To be more precise, in order to cancel the aliasing within the aliasing cancellation portion 102, combiner 74 performs an overlap-add process between retransforms 96 and 100 within portion 102, using the resampled version as obtained by resampler 72. The overlap-add process yields, along with the windowing for generating the transforms 94, an aliasing free and constantly amplified reconstruction of the information signal 90 at output 78 even across border 82, even though the sample rate of information signal 90 changes at time instant 82 from a higher sample rate to a lower sample rate.

Thus, as it turns out from the above description of FIG. 5, the ratio of the transform length of the retransformation applied to the transform 94 of the windowed version of the preceding time region 84 to a temporal length of the preceding region 84 differs from a ratio of a transform length of the retransformation applied to the windowed version of the succeeding region 86 to a temporal length of the succeeding region 86 by a factor which corresponds to the sample rate change at border 82 between both regions 84 and 86. In the example just described, this ratio change has been initiated illustratively by an external signal 98. The temporal length of the preceding and succeeding time regions 84 and 86 have been assumed to be equal to each other and the retransformer 70 was configured to restrict the application of the retransformation on the transform 94 of the windowed version of the succeeding region 86 on a low-frequency portion thereof, such as, for example, up to the $N_k'$-th transform coefficient of the transform. Naturally, such grabbing could have already been taken place with respect to the transform 94 of the windowed version of the preceding region 84, too. Moreover, contrary to the above illustration, the sample rate change at the border 82 could have been performed into the other direction, and thus no grabbing may be performed with respect to the succeeding region 86, but merely with respect to the transform 94 of the windowed version of the preceding region 84 instead.

To be more precise, up to now, the mode of operation of the information signal reconstructor of FIG. 5 has been illustratively described for a case where a transform length of the transform 94 of the windowed version of the regions of the information signal and a temporal length of the regions of the information signal are constant, i.e. the lapped transform representation 92 was a spectrogram having a constant time/frequency resolution. In order to locate the border 82, the information signal reconstructor 80 was exemplarily described to be responsive to a control signal 98.

Accordingly, in this configuration the information signal reconstructor 80 of FIG. 5 could be part of resampler 14 of FIG. 3*a*. In other words, the resampler 14 of FIG. 3*a* could be composed of a concatenation of a filterbank 38 for providing a lapped transform representation of an information signal, and an inverse filterbank comprising an information signal reconstructor 80 configured to reconstruct, using aliasing cancellation, the information signal from the lapped transform representation of the information signal as described up to now. The retransformer 70 of FIG. 5 could accordingly be configured as a QMF synthesis filterbank, with the filterbank 38 being implemented as QMF analysis filterbank, for example.

As became clear from the description of FIGS. 1*a* and 4*a*, an information signal encoder could comprise such a resampler along with a compression stage such as core encoder 16 or the conglomeration core encoder 16 and parametric envelope coder 54. The compression stage would be configured to compress the reconstructed information signal. As is shown in FIGS. 1 and 4*a*, such an information signal encoder could further comprise a sample rate controller configured to control the control signal 98 depending on an external information on available transmission bitrate, for example.

However, alternatively, the information signal reconstructor of FIG. 5 could be configured to locate the border 82 by detecting a change in the transform length of the windowed version of the regions of the information signal within the lapped transform representation. In order to make this possible implementation clearer, see 92' in FIG. 5 where an example of an inbound lapped transform representation is shown according to which the consecutive transforms 94 within the representation 92' are still arriving at the retransformer 70 at a constant transform rate Δt, but the transform length of the individual transform changes. In FIG. 5, it is, for example, assumed that the transform length of the transform of the windowed version of the preceding time region 84 is greater than (namely $N_k$) the transform length of the transform of the windowed version of the succeeding region 86, which is assumed to be merely $N_k'$. Somehow, retransformer 70 is able to correctly parse the information on the lapped transform representation 92' from the input data stream and accordingly retransformer 70 may adapt a transform length of the retransformation applied on the transform of the windowed version of the consecutive regions of the information signal to the transform length of the consecutive transforms of the lapped transform representation 92'. Accordingly, retransformer 70 may use a transform length of $N_k$ for the retransformation of the transform 94 of the windowed version of the preceding time region 84, and a transform length of a $N_k'$ for the retransformation of the transform of the windowed version of the succeeding time region 86, thereby obtaining the sample rate discrepancy between retransformations which has already been discussed above and is shown in FIG. 5 in the top middle of this figure. Accordingly, as far as the mode of operation of the information signal reconstructor 80 of FIG. 5 is concerned, this mode of operation coincides with the above description besides the just mentioned difference in adapting the retransformation's transform length to the transform length of the transforms within the lapped transform representation 92'.

Thus, in accordance with the latter functionality, the information signal reconstructor would not have to be responsive to an external control signal 98. Rather, the inbound lapped transform representation 92' could be sufficient in order to inform the information signal reconstructor on the sample rate change points in time.

The information signal reconstructor 80 operating as just described could be used in order to form the retransformer 36 of FIG. 2*b*. That is, an information signal decoder could comprise a decompressor 34 configured to reconstruct the lapped transform representation 92' of the information signal from a data stream. The reconstruction could, as already described above, involve entropy decoding. The time-varying transform length of the transforms 94 could be signaled within the data stream entering decompressor 34 in an appropriate way. An information signal reconstructor as shown in FIG. 5 could be used as the reconstructor 36. Same could be configured to reconstruct, using aliasing cancellation, the information signal from the lapped transform representation as provided by decompressor 34. In the latter case, the retransformer 70 could, for example, be performed to use an IMDCT in order to perform the retransformations, and the transform 94 could be represented by real valued coefficients rather than complex valued ones.

Thus, the above embodiments enable the achievement of many advantages. For audio codecs operating at a full range of bitrate, for example, such as from 8 kb per second to 128 kb per second, an optimal sample rate may depend on the bitrate as has been described above with respect to FIGS. 4*a* and 4*b*. For lower bitrates, only the lower frequency should, for example, be coded with more accurate coding methods like ACELP or transform coding while the higher frequencies should be coded in a parametric way. For high bitrates the full spectrum would, for example, be coded with the accurate methods. This would mean, for example, that those accurate methods should code signals at an optimal representation. The sample rate of those signals should be optimized allowing the transportation of the most relevant signal frequency components according to the Nyquist theorem. Thus, look at FIG. 4*a*. The sample rate controller 120 shown therein could be configured to control the sample bitrate at which the information signal is fed into core encoder 16 depending on the available transmission bitrate. This corresponds to feeding only a lower-frequency subportion of the analysis filterbank's spectrum into the core encoder 16. The remaining higher-frequency portion could be fed into the parametric envelope coder 54. Time-variance in the sample rate and the transmission bitrate is, respectively, as described above, not a problem.

The description of FIG. 5 concerns the information signal reconstruction which could be used in order to deal with a time aliasing cancellation problem at the sample rate change time instances. As already mentioned above with respect to FIGS. 1 to 4*b*, some measures also have to be done at interfaces between consecutive modules in the sceneries of FIGS. 1 to 4*b*, where a transformer is to generate a lapped transform representation as then entering the information signal reconstructor of FIG. 5.

Figure 6:
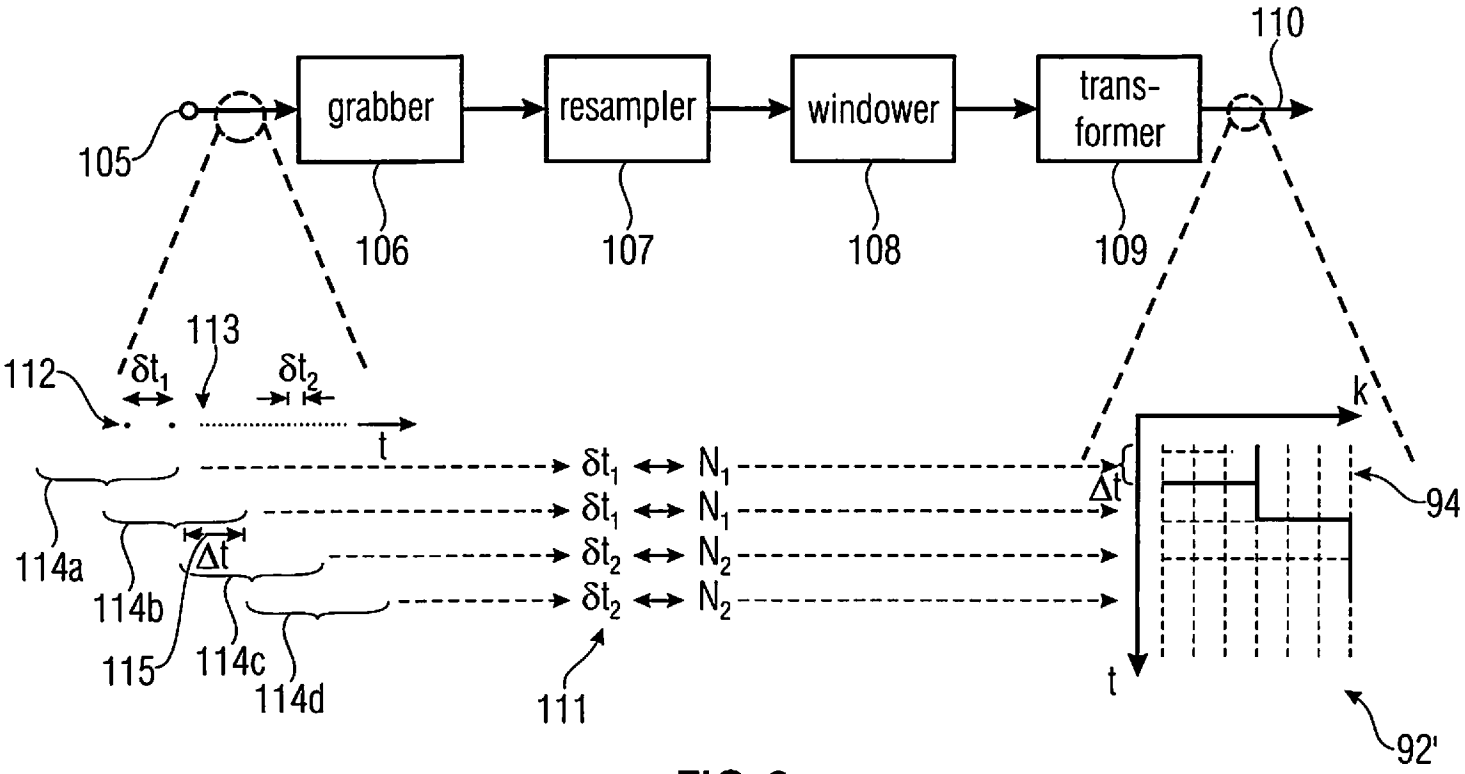
FIG. 6 shows a block diagram of an information signal transformer in accordance with embodiment.

FIG. 6 shows such an embodiment for an information signal transformer. The information signal transformer of FIG. 6 comprises an input 105 for receiving an information signal in the form of a sequence of samples, a grabber 106 configured to grab consecutive, overlapping regions of the information signal, a resampler 107 configured to apply a resampling onto at least a subset of the consecutive, overlapping regions so that each of the consecutive, overlapping regions has a constant sample rate, wherein however the constant sample rate varies among the consecutive, overlapping regions, a windower 108 configured to apply a windowing on the consecutive, overlapping regions, and a transformer configured to apply a transformation individually onto the windowed portions so as to obtain a sequence of transforms 94 forming the lapped transform representation 92' which is then output at an output 110 of information signal transformer of FIG. 6. The windower 108 may use a Hamming windowing or the like.

The grabber 106 may be configured to perform the grabbing such that the consecutive, overlapping regions of the information signal have equal length in time such as, for example, 20 ms each.

Thus, grabber 106 forwards to resampler 107 a sequence of information signal portions. Assuming that the inbound information signal has a time-varying sample rate which switches from a first sample rate to a second sample rate at a predetermined time instant, for example, the resampler 107 may be configured to resample, by interpolation, the inbound information signal portions temporally encompassing the predetermined time instant such that the consecutive sample rate changes once from the first sample rate to the second sample rate as illustrated at 111 in FIG. 6. To make this clearer, FIG. 6 illustratively shows a sequence of samples 112 where the sample rate switches at some time instant 113, wherein the constant time-length regions 114*a* to 114*d* exemplarily are grabbed with a constant region offset 115 $\Delta t$ defining—along with the constant region time-length—an predetermined overlap between consecutive regions 114*a* to 114*d* such as an overlap of 50% per consecutive pairs of regions, although this is merely to be understood as an example. The first sample rate before time instant 113 is illustrated with St, and the sample rate after time instant 113 is indicated by $\delta t_2$. As illustrated at 111, resampler 107 may, for example, be configured to resample region 114*b* so as to have the constant sample rate $\delta t_1$, wherein however region 114*c* succeeding in time is resampled to have the constant sample rate $\delta t_2$. In principle, it may suffice if the resampler 107 resamples, by interpolation, the subpart of the respective regions 114*b* and 114*c* temporally encompassing time instant 113, which does not yet have the target sample rate. In case of region 114*b*, for example, it may suffice if resampler 107 resamples the subpart thereof succeeding in time, time instant 113, whereas in case of region 114*c*, the subpart preceding time instant 113 may be resampled only. In that case, due to the constant time length of grabbed regions 114*a* to 114*d*, each resampled region has a number of time samples $N_{1,2}$ corresponding to the respective constant sample rate $\delta t_{1,2}$. Windower 108 may adapt its window or window length to this number of samples for each inbound portion, and the same applies to transformer 109 which may adapt its transform length of its transformation accordingly. That is, in case of the example illustrated at 111 in FIG. 6, the lapped transform representation at output 110 has a sequence of transforms, the transform length of which varies, i.e. increases and decreases, in line with, i.e. linear dependent on, the number of samples of the consecutive regions and, in turn, on the constant sample rate at which the respective region has been resampled.

It should be noted that the resampler 107 may be configured such that same registers the sample rate change between the consecutive regions 114*a* to 114*d* such that the number of samples which have to be resampled within the respective regions is minimum. However, the resampler 107 may, alternatively, be configured differently. For example, the resampler 107 may be configured to favor upsampling over downsampling or vice versa, i.e. to perform the resampling such that all regions overlapping with time instant 113 are either resampled onto the first sample rate $\delta t_1$ or onto the second sample rate $\delta t_2$.

The information signal transformer of FIG. 6 may be used, for example, in order to implement the transformer 30 of FIG. 2*a*. In that case, for example, the transformer 109 may be configured to perform an MDCT.

In this regard, it should be noted that the transform length of the transformation applied by the transformer 109 may even be greater than the size of regions 114*c* measured in the number of resampled samples. In that case, the areas of the transform length which extend beyond the windowed regions output by windower 108 may be set to zero before applying the transformation onto them by transformer 109.

Figure 7B:
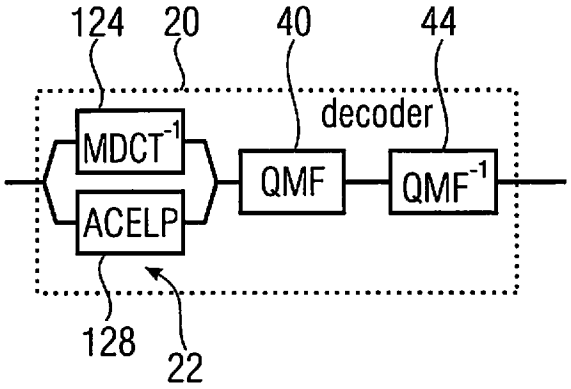
FIG. 7*b* shows a block diagram of an information signal decoder in accordance with a further embodiment where an information signal reconstructor according to FIG. 5 could be used.
Figure 7A:
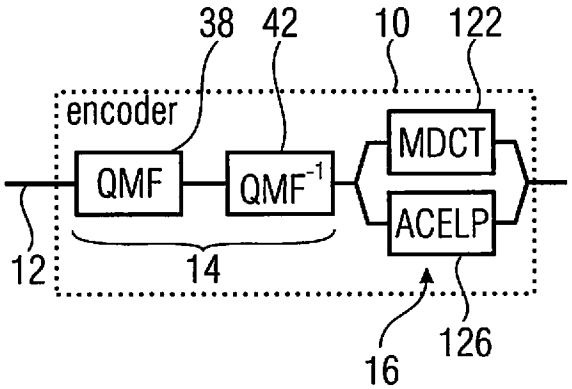
FIG. 7*a* shows a block diagram of an information signal encoder in accordance with a further embodiment where an information signal reconstructor according to FIG. 5 could be used.

Before proceeding to describe possible implementations for realizing the interpolation 104 in FIG. 5 and the interpolation within resampler 107 in FIG. 6 in more detail, reference is made to FIGS. 7*a* and 7*b* which show possible implementations for the encoders and decoders of FIGS. 1*a* and 1*b*. In particular, the resamplers 14 and 24 are embodied as shown in FIGS. 3*a* and 3*b*, whereas the core encoder and core decoder 16 and 22, respectively, are embodied as a codec being able to switch between MDCT-based transform coding on the one hand and CELP coding, such as ACELP coding, on the other hand. The MDCT based coding/decoding branches 122 and 124, respectively, could be for example a TCX encoder and TCX decoder, respectively. Alternatively, an AAC coder/decoder pair could be used. For the CELP coding an ACELP encoder 126 could form the other coding branch of the core encoder 16, with an ACELP decoder 128 forming the other decoding branch of core decoder 22. The switching between both coding branches could be performed on a frame by frame basis as it is the case in USAC [2] or AMR-WB+ [1] to the standard text of which reference is made for more details regarding these coding modules.

Taking the encoder and the decoder of FIGS. 7*a* and 7*b* as a further specific example, a scheme of allowing a switching of the internal sampling rate for entering the coding branches 122 and 126 and for reconstruction by decoding branches 124 and 128 is described in more detail below. In particular, the input signal entering at input 12 may have a constant sample rate such as, for example, 32 kHz. The signal may be resampled using the QMF analysis and synthesis filterbank pair 38 and 42 in the manner described above, i.e. with a suitable analysis and synthesis ratio regarding the number of bands such as 1.25 or 2.5, leading to an internal time signal entering the core encoder 16 which has a dedicated sample rate of, for example, 25.6 kHz or 12.8 kHz. The downsampled signal is thus coded using either one of the coding branches of coding modes such as using an MDCT representation and a classic transform coding scheme in case of coding branch 122, or in time-domain using ACELP, for example, in the coding branch 126. The data stream thus formed by the coding branches 126 and 122 of the core encoder 16 is output and transported to the decoding side where same is subject to reconstruction.

Figure 8:
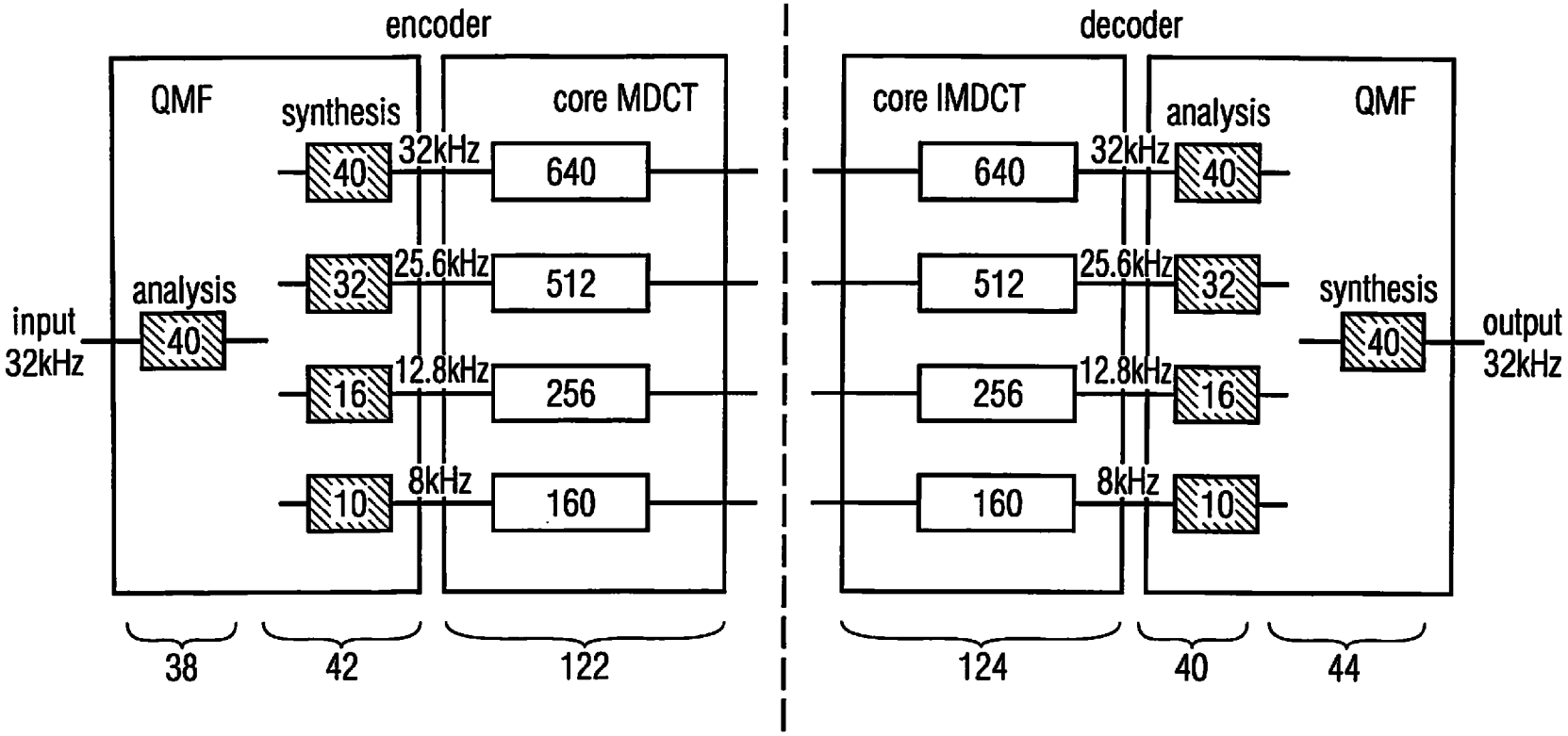
FIG. 8 shows a schematic showing the sample rate switching scenarios occurring in the information signal encoder and decoder of FIGS. 6*a* and 6*b* in accordance with an embodiment.

For switching the internal sample rate, the filterbanks 38 to 44 need to be adapted on a frame by frame basis according to the internal sample rate at which core encoder 16 and core decoder 22 shall operate. FIG. 8 shows some possible switching scenarios wherein FIG. 8 merely shows the MDCT coding path of encoder and decoder.

In particular, FIG. 8 shows that the input sample rate which is assumed to be 32 kHz may be downsampled to any of 25.6 kHz, 12.8 kHz or 8 kHz with a further possibility of maintaining the input sample rate. Depending on the chosen sample rate ratio between input sample rate and internal sample rate, there is a transform length ratio between filterbank analysis on the one hand and filterbank synthesis on the other hand. The ratios are derivable from FIG. 8 within the grey shaded boxes: 40 subbands in filterbanks 38 and 44, respectively, independent from the chosen internal sample rate, and 40, 32, 16 or 10 subbands in filterbanks 42 and 40, respectively, depending on the chosen internal sample rate. The transform length of the MDCT used within the core encoder is adapted to the resulting internal sample rate such that the resulting transform rate or transform pitch interval measured in time is constant or independent from the chosen internal sample rate. It may, for example, be constantly 20 ms resulting in a transform length of 640, 512, 256 and 160, respectively, depending on the chosen internal sample rate.

Using the principals outlined above, it is possible to switch the internal sample rate with obeying the following constraints regarding the filterbank switch:

- No additional delay is caused during a switch;
- The switch or sample rate change may happen instantaneously;
- The switching artifacts are minimized or at least reduced; and
- The computational complexity is low.

Basically, filterbanks 38-44 and the MDCT within the core coder, are lapped transforms wherein the filterbanks may use a higher overlap of the windowed regions when compared to the MDCT of the core encoder and decoder. For example, a 10-times overlap may apply for the filterbanks, whereas a 2-times overlap may apply for the MDCT 122 and 124. For lapped transforms, the state buffers may be described as an analysis-window buffer for analysis filterbanks and MDCTs, and overlap-add buffers for synthesis filterbanks and IMDCTs. In case of rate switching, those state buffers should be adjusted according to the sample rate switch in the manner having been described above with respect to FIG. 5 and FIG. 6. In the following, a more detailed discussion is provided regarding the interpolation which may also be performed at the analysis side discussed in FIG. 6, rather than the synthesis case discussed with respect to FIG. 5. The prototype or window of the lapped transform may be adapted. In order to reduce the switching artifacts, the signal components in the state buffers should be preserved in order to maintain the aliasing cancellation property of the lapped transform.

In the following, a more detailed description is provided as to how to perform the interpolation 104 within resampler 72.

Two cases may be distinguished:

1) Switching up is a process according to which the sample rate increases from preceding time portion 84 to a subsequent or succeeding time portion 86.

2) Switching down is a process according to which the sample rate decreased from preceding time region 84 to succeeding time region 86.

Assuming a switching-up, i.e. such as from 12.8 kHz (256 samples per 20 ms) to 32 kHz (640 sample per 20 ms), the state buffers such as the state buffer of resampler 72 illustratively shown with reference sign 130 in FIG. 5, or its content needs to be expanded by a factor corresponding to the sample rate change, such as 2.5 in the given example. Possible solutions for an expansion without causing additional delay are, for example, a linear interpolation or spline interpolation. That is, resampler 72 may, on the fly, interpolate the samples of the tail of retransform 96 concerning the preceding time region 84, as lying within time interval 102, within state buffer 130. The state buffer may, as illustrated in FIG. 5, act as a first-in-first-out buffer. Naturally, not all frequency components which are necessitated for a complete aliasing cancellation can be obtained by this procedure, but at least a lower frequency such as, for example, from 0 to 6.4 kHz can be generated without any distortions and from a psychoacoustical point of view, those frequencies are the most relevant ones.

For the cases of switching down to lower sample rates, linear or spline interpolation can also be used to decimate the state buffer accordingly without causing additional delay. That is, resampler 72 may decimate the sample rate by interpolation. However, a switch down to sample rates where the decimation factor is large, such as switching from 32 kHz (640 samples per 20 ms) to 12.8 kHz (256 samples per 20 ms) where the decimation factor is 2.5, can cause severely disturbing aliasing if the high frequency components are not removed. To come around this phenomenon, the synthesis filtering may be engaged, where higher frequency components can be removed by "flushing" the filterbank or retransformer. This means that the filterbank synthesizes less frequency components at the switching instant and therefore clears up the overlap-add buffer from high spectral components. To be more precise, imagine a switching-down from a first sample rate for preceding time region 84 to a lower sample rate for succeeding time region 86. Deviating from the above description, retransformer 70 may be configured to prepare the switching-down by not letting all frequency components of the transform 94 of the windowed version of the preceding time region 84 participate in the retransformation. Rather, retransformer 70 may exclude non-relevant high frequency components of the transform 94 from the retransformation by setting them to 0, for example or otherwise reducing their influence onto the retransform such as by gradually attenuating these higher frequency components increasingly. For example, the affected high frequency components may be those above frequency component $N_k'$. Accordingly, in the resulting information signal, a time region 84 has intentionally been reconstructed at a spectral bandwidth which is lower than the bandwidth which would have been available in the lapped transform representation input at input 76. On the other hand, however, aliasing problems otherwise occurring at the overlap-add process by unintentionally introducing higher frequency portions into the aliasing cancellation process within combiner 74 despite the interpolation 104 are avoided.

As an alternative, an additional low sample representation can be generated simultaneously to be used in an appropriate state buffer for a switch from a higher sample rate representation. This would ensure that the decimation factor (in case decimation would be needed) is kept relatively low (i.e. smaller than 2) and therefore no disturbing artifacts, caused from aliasing, will occur. As mentioned before, this would not preserve all frequency components but at least the lower frequencies that are of interest regarding psychoacoustic relevance.

Thus, in accordance with a specific embodiment, it could be possible to modify the USAC codec in the following way in order to obtain a low delay version of USAC. Firstly, only TCX and ACELP coding modes could be allowed. AAC modes could be avoided. The frame length could be selected to obtain a framing of 20 ms. Then, the following system parameters could be selected depending on the operation mode (super-wideband (SWB), wideband (WB), narrowband (NB), full bandwidth (FB)) and on the bitrate. An overview of the system parameters is given in the following table.

| Mode | Input sampling rate [kHz] | Internal sampling rate [kHz] | Frame length [samples] |
|---|---|---|---|
| NB | 8 kHz | 12.8 kHz | 256 |
| WB | 16 kHz | 12.8 kHz | 256 |
| SWB low rates (12-32 kbps) | 32 kHz | 12.8 kHz | 256 |
| SWB high rates (48-64 kbps) | 32 kHz | 25.6 kHz | 512 |
| SWB very high rates (96-128 kbps) | 32 kHz | 32 kHz | 640 |
| FB | 48 kHz | 48 kHz | 960 |

As far as the narrow band mode is concerned, the sample rate increase could be avoided and replaced by setting the internal sampling rate to be equal to the input sampling rate, i.e. 8 kHz with selecting the frame length accordingly, i.e. to be 160 samples long. Likewise, 16 kHz could be chosen for the wideband operating mode with selecting the frame length of the MDCT for TCX to be 320 samples long instead of 256.

In particular, it would be possible to support switching operation through an entire list of operation points, i.e. supported sampling rates, bit rates and bandwidths. The following table outlines the various configurations regarding the internal sampling rate of a just-anticipated low-delay version of an USAC codec.

Table showing matrix of internal sampling rate modes of a low-delay USAC codec

| | Input Sampling Rate | | | |
|---|---|---|---|---|
| Bandwidth | 8 kHz | 16 kHz | 32 kHz | 48 kHz |
| NB | 12.8 kHz | 12.8 kHz | 12.8 kHz | 12.8 kHz |
| WB | | 12.8 kHz | 12.8 kHz | 12.8 kHz |
| SWB | | | 12.8, 25.6, 32 kHz | 12.8, 25.6, 32 kHz |
| FB | | | | 12.8, 25.6, 32, 48 kHz |

As a side information, it should be noted that the resampler according to FIGS. 2*a* and 2*b* needs not to be used. An IIR filter set could alternately be provided to assume responsibility for the resampling functionality from the input sampling rate to the dedicated core sampling frequency. The delay of those IIR filters is below 0.5 ms but due to the odd ratio between input and output frequency, the complexity is quite considerable. Assuming an identical delay for all IIR filters, switching between different sampling rates can be enabled.

Accordingly, the use of resampler embodiment of FIGS. 2*a* and 2*b* may be advantageous. The QMF filter bank of the parametric envelope module (i.e. SBR) may participate in co-operating to instantiate the resampling functionality as described above. In case of SWB, this would add a synthesis filter bank stage to the encoder while the analysis stage is already in use due to the SBR encoder module. At the decoder side, the QMF is already responsible for providing the upsampling functionality when SBR is enabled. This scheme can be used in all other bandwidth modes. The following table provides an overview of the necessitated QMF configurations.

Table List of QMF configurations at encoder side (number of analysis bands/number of synthesis bands). Another possible configuration can be obtained by dividing all numbers by a factor of 2.

| Internal SR | Input Sampling Rate | | | |
|---|---|---|---|---|
| LD-USAC | 8 kHz | 16 kHz | 32 kHz | 48 kHz |
| 12.8 kHz | 20/32 | 40/32 | 80/32 | 120/32 |
| 25.6 kHz | | — | 80/64 | 120/64 |
| 32 kHz | | | bypass with delay | 120/80 |
| 48 kHz | | | | bypass with delay |

Assuming a constant input sampling frequency, the switching between internal sampling rates is enabled by switching the QMF synthesis prototype. At the decode side the inverse operation can be applied. Note that the bandwidth of one QMF band is identical over the entire range of operation points.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus. Some or all of the method steps may be executed by (or using) a hardware apparatus, like for example, a microprocessor, a programmable computer or an electronic circuit. In some embodiments, some one or more of the most important method steps may be executed by such an apparatus.

Depending on certain implementation requirements, embodiments of the invention can be implemented in hardware or in software. The implementation can be performed using a digital storage medium, for example a floppy disk, a DVD, a Blu-Ray, a CD, a ROM, a PROM, an EPROM, an EEPROM or a FLASH memory, having electronically readable control signals stored thereon, which cooperate (or are capable of cooperating) with a programmable computer system such that the respective method is performed. Therefore, the digital storage medium may be computer readable.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein. The data carrier, the digital storage medium or the recorded medium are typically tangible and/or non-transitionary.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

A further embodiment according to the invention comprises an apparatus or a system configured to transfer (for example, electronically or optically) a computer program for performing one of the methods described herein to a receiver. The receiver may, for example, be a computer, a mobile device, a memory device or the like. The apparatus or system may, for example, comprise a file server for transferring the computer program to the receiver.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods are performed by any hardware apparatus.

While this invention has been described in terms of several advantageous embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

LITERATURE

[1]: 3GPP, "Audio codec processing functions; Extended Adaptive Multi-Rate—Wideband (AMR-WB+) codec; Transcoding functions", 2009, 3GPP TS 26.290.

[2]: USAC codec (Unified Speech and Audio Codec), ISO/IEC CD 23003-3 dated Sep. 24, 2010

The invention claimed is:

1. Information signal reconstructor configured to reconstruct, using aliasing cancellation, an information signal from a lapped transform representation of the information signal comprising, for each of consecutive, overlapping regions of the information signal, a transform of a windowed version of the respective region, wherein the information signal reconstructor is configured to reconstruct the information signal at a sample rate which changes at a border between a preceding region and a succeeding region of the information signal from a first sample rate within the preceding region to a second sample rate, different from the first sample rate, within the succeeding region, the information signal reconstructor comprises a retransformer configured to apply a retransformation on the transform of the windowed version of the preceding region so as to acquire a retransform for the preceding region, and apply a retransformation on the transform of the windowed version of the succeeding region so as to acquire a retransform for the succeeding region, wherein the retransform for the preceding region and the retransform for the succeeding region overlap at an aliasing cancellation portion at the border between the preceding and succeeding regions;

a resampler configured to resample, by interpolation, the retransform for preceding region and/or the retransform for the succeeding region at the aliasing cancellation portion according to a sample rate change at the border; and a combiner configured to perform aliasing cancellation between the retransforms for the preceding and succeeding regions as acquired by the resampling at the aliasing cancellation portion so as to reconstruct the information signal in a form sampled at the first sample rate within a portion of the retransform for the preceding region, preceding the aliasing cancellation portion, and sampled at the second sample rate within a portion of the retransform for the succeeding region, succeeding the aliasing cancellation portion.

2. Information signal reconstructor according to claim 1, wherein the resampler is configured to resample the retransform for the preceding region at the aliasing cancellation portion according to the sample rate change at the border.

3. Information signal reconstructor according to claim 1, wherein a ratio of a transform length of the retransformation applied to the transform of the windowed version of the preceding region to a temporal length of the preceding region differs from a ratio of a transform length of the retransformation applied to the windowed version of the succeeding region to a temporal length of the succeeding region by a factor corresponding to the sample rate change.

4. Information signal reconstructor according to claim 3, wherein the temporal lengths of the preceding and succeeding regions are equal to each other, and the retransformer is configured to restrict the application of the retransformation on the transform of the windowed version of the preceding region to a low-frequency portion of the transform of the windowed version of the preceding region and/or restrict the application of the retransformation on the transform of the windowed version of the succeeding region on a low-frequency portion of the transform of the windowed version of the succeeding region.

5. Information signal reconstructor according to claim 1, wherein a transform length of the transform of the windowed version of the regions of the information signal and a temporal length of the regions of the information signal are constant, and the information signal reconstructor is configured to locate the border responsive to a control signal.

6. Resampler composed of a concatenation of a filterbank for providing a lapped transform representation of an information signal, and an inverse filterbank comprising an information signal reconstructor configured to reconstruct, using aliasing cancellation, the information signal from the lapped transform representation of the information signal, wherein the lapped transform representation of the information signal comprises, for each of consecutive, overlapping regions of the information signal, a transform of a windowed version of the respective region, wherein the information signal reconstructor is configured to reconstruct the information signal at a sample rate which changes at a border between a preceding region and a succeeding region of the information signal from a first sample rate within the preceding region to a second sample rate, different from the first sample rate, within the succeeding region, the information signal reconstructor comprises a retransformer configured to apply a retransformation on the transform of the windowed version of the preceding region so as to acquire a retransform for the preceding region, and apply a retransformation on the transform of the windowed version of the succeeding region so as to acquire a retransform for the succeeding region, wherein the retransform for the preceding region and the retransform for the succeeding region overlap at an aliasing cancellation portion at the border between the preceding and succeeding regions;

a resampler configured to resample, by interpolation, the retransform for the preceding region and/or the retransform for the succeeding region at the aliasing cancellation portion according to a sample rate change at the border; and a combiner configured to perform aliasing cancellation between the retransforms for the preceding and succeeding regions as acquired by the resampling at the aliasing cancellation portion so as to reconstruct the information signal in a form sampled at the first sample rate within a portion of the retransform for the preceding region, preceding the aliasing cancellation portion, and sampled at the second sample rate within a portion of the retransform for the succeeding region, succeeding the aliasing cancellation portion, wherein a transform length of the transform of the windowed version of the regions of the information signal and a temporal length of the regions of the information signal are constant, and the information signal reconstructor is configured to locate the border responsive to a control signal.

7. Information signal encoder comprising a resampler composed of a concatenation of a filterbank for providing a lapped transform representation of an information signal, and an inverse filterbank comprising an information signal reconstructor configured to reconstruct, using aliasing cancellation, the information signal from the lapped transform representation of the information signal, the lapped transform representation of the information signal comprises, for each of consecutive, overlapping regions of the information signal, a transform of a windowed version of the respective region, wherein the information signal reconstructor is configured to reconstruct the information signal at a sample rate which changes at a border between a preceding region and a succeeding region of the information signal from a first sample rate within the preceding region to a second sample rate, different from the first sample rate, within the succeeding region, the information signal reconstructor comprises a retransformer configured to apply a retransformation on the transform of the windowed version of the preceding region so as to acquire a retransform for the preceding region, and apply a retransformation on the transform of the windowed version of the succeeding region so as to acquire a retransform for the succeeding region, wherein the retransform for the preceding region and the retransform for the succeeding region overlap at an aliasing cancellation portion at the border between the preceding and succeeding regions;

a resampler configured to resample, by interpolation, the retransform for preceding region and/or the retransform for the succeeding region at the aliasing cancellation portion according to a sample rate change at the border; and a combiner configured to perform aliasing cancellation between the retransforms for the preceding and succeeding regions as acquired by the resampling at the aliasing cancellation portion so as to reconstruct the information signal in a form sampled at the first sample rate within a portion of the retransform for the preceding region, preceding the aliasing cancellation portion, and sampled at the second sample rate within a portion of the retransform for the succeeding region, succeeding the aliasing cancellation portion, wherein a transform length of the transform of the windowed version of the regions of the information signal and a temporal length of the regions of the information signal are constant, and the information signal reconstructor is configured to locate the border responsive to a control signal, and a compression stage configured to compress the reconstructed information signal, the information signal encoder further comprising a sample rate control configured to control the control signal depending on an external information on available transmission bitrate.

8. Information signal reconstructor according to claim 1, wherein the transform length of the transform of the windowed version of the regions of the information signal varies, while a temporal length of the regions of the information signal is constant, wherein the information signal reconstructor is configured to locate the border by detecting a change in the transform length of the windowed version of the regions of the information signal.

9. Information signal reconstructor according to claim 8, wherein the retransformer is configured to adapt a transform length of the retransformation applied on the transform of the windowed version of the preceding and succeeding regions to the transform length of the transform of the windowed version of the preceding and succeeding regions.

10. Information signal reconstructor comprising a decompressor configured to reconstruct a lapped transform representation of an information signal from a data stream, and an information signal reconstructor configured to reconstruct, using aliasing cancellation, an information signal from a lapped transform representation of the information signal comprising, for each of consecutive, overlapping regions of the information signal, a transform of a windowed version of the respective region, wherein the information signal reconstructor is configured to reconstruct the information signal at a sample rate which changes at a border between a preceding region and a succeeding region of the information signal from a first sample rate within the preceding region to a second sample rate, different from the first sample rate, within the succeeding region, the information signal reconstructor comprises a retransformer configured to apply a retransformation on the transform of the windowed version of the preceding region so as to acquire a retransform for the preceding region, and apply a retransformation on the transform of the windowed version of the succeeding region so as to acquire a retransform for the succeeding region, wherein the retransform for the preceding region and the retransform for the succeeding region overlap at an aliasing cancellation portion at the border between the preceding and succeeding regions;

a resampler configured to resample, by interpolation, the retransform for preceding region and/or the retransform for the succeeding region at the aliasing cancellation portion according to a sample rate change at the border; and a combiner configured to perform aliasing cancellation between the retransforms for the preceding and succeeding regions as acquired by the resampling at the aliasing cancellation portion so as to reconstruct the information signal in a form sampled at the first sample rate within a portion of the retransform for the preceding region, preceding the aliasing cancellation portion, and sampled at the second sample rate within a portion of the retransform for the succeeding region, succeeding the aliasing cancellation portion, wherein the transform length of the transform of the windowed version of the regions of the information signal varies, while a temporal length of the regions of the information signal is constant, wherein the information signal reconstructor is configured to locate the border by detecting a change in the transform length of the windowed version of the regions of the information signal, wherein the retransformer is configured to adapt a transform length of the retransformation applied on the transform of the windowed version of the preceding and succeeding regions to the transform length of the transform of the windowed version of the preceding and succeeding regions, configured to reconstruct, using aliasing cancellation, the information signal from the lapped transform representation.

11. Information signal reconstructor according to claim 1, wherein the lapped transform is critically sampled such as an MDCT.

12. Information signal reconstructor according to claim 1, wherein the lapped transform representation is a complex valued filterbank.

13. Information signal reconstructor according to claim 1, wherein resampler is configured to use a linear or spline interpolation for the interpolation.

14. Information signal reconstructor according to claim 1, wherein the sample rate decreases at the border and the retransformer is configured to, in applying the retransformation on the transform of the windowed version of the preceding region, attenuate, or set to zero, higher frequencies of the transform of the windowed version of the preceding region.

15. Information signal transformer configured to generate a lapped transform representation of an information signal using an aliasing-causing lapped transform, comprising an input for receiving the information signal in the form of a sequence of samples;

a grabber configured to grab consecutive, overlapping regions of the information signal;

a resampler configured to apply, by interpolation, a resampling onto at least a subset of the consecutive, overlapping regions of the information signals the resampling resulting in each of the consecutive, overlapping portions comprising a respective constant sample rate, with the respective constant sample rate varying among the consecutive, overlapping regions;

a windower configured to apply a windowing on the consecutive, overlapping regions of the information signal; and a transformer configured to individually apply a transform on the windowed regions.

16. Information signal transformer according to claim 15, wherein the grabber is configured to perform the grabbing of the consecutive, overlapping regions of the information signal such that the consecutive, overlapping regions of the information signal are of constant time length.

17. Information signal transformer according to claim 15, wherein the grabber is configured to perform the grabbing of the consecutive, overlapping regions of the information signal such that the consecutive, overlapping regions of the information signal comprise a constant time offset.

18. Information signal transformer according to claim 16, wherein the sequence of samples comprises a varying sample rate switching from a first sample rate to a second sample rate at a predetermined time instant, wherein the resampler is configured to apply the resampling onto the consecutive, overlapping regions overlapping with the predetermined time instant so that the constant sample rate thereof switches merely once from the first sample rate to the second sample rate.

19. Information signal transformer according to claim 18, wherein the transformer is configured to adapt a transform length of the transform of each windowed region to a number of samples of the respective windowed region.

20. Method for reconstructing, using aliasing cancellation, an information signal from a lapped transform representation of the information signal comprising, for each of consecutive, overlapping regions of the information signal, a transform of a windowed version of the respective region, wherein the information signal reconstructor is configured to reconstruct the information signal at a sample rate which changes at a border between a preceding region and a succeeding region of the information signal from a first sample rate within the preceding region to a second sample rate, different from the first sample rate, within the succeeding region, the method comprising applying a retransformation on the transform of the windowed version of the preceding region so as to acquire a retransform for the preceding region, and apply a retransformation on the transform of the windowed version of the succeeding region so as to acquire a retransform for the succeeding region, wherein the retransform for the preceding region and the retransform for the succeeding region overlap at an aliasing cancellation portion at the border between the preceding and succeeding regions;

resampling, by interpolation, the retransform for preceding region and/or the retransform for the succeeding region at the aliasing cancellation portion according to a sample rate change at the border; and performing aliasing cancellation between the retransforms for the preceding and succeeding regions as acquired by the resampling at the aliasing cancellation portion so as to reconstruct the information signal in a form sampled at the first sample rate within a portion of the retransform for the preceding region, preceding the aliasing cancellation portion, and sampled at the second sample rate within a portion of the retransform for the succeeding region, succeeding the aliasing cancellation portion.

21. Method for generating a lapped transform representation of an information signal using an aliasing-causing lapped transform, comprising receiving the information signal in the form of a sequence of samples;

grabbing consecutive, overlapping regions of the information signal;

applying, by interpolation, a resampling onto at least a subset of the consecutive, overlapping regions of the information signals the resampling resulting in each of the consecutive, overlapping portions comprising a respective constant sample rate, with the respective constant sample rate varying among the consecutive, overlapping regions;

applying a windowing on the consecutive, overlapping regions of the information signal; and individually applying a transformation on the windowed regions.

22. Non-transitory computer-readable medium having stored thereon a computer program comprising a program code for performing, when running on a computer, a method for reconstructing, using aliasing cancellation, an information signal from a lapped transform representation of the information signal comprising, for each of consecutive, overlapping regions of the information signal, a transform of a windowed version of the respective region, wherein the information signal reconstructor is configured to reconstruct the information signal at a sample rate which changes at a border between a preceding region and a succeeding region of the information signal from a first sample rate within the preceding region to a second sample rate, different from the first sample rate, within the succeeding region, the method comprising applying a retransformation on the transform of the windowed version of the preceding region so as to acquire a retransform for the preceding region, and apply a retransformation on the transform of the windowed version of the succeeding region so as to acquire a retransform for the succeeding region, wherein the retransform for the preceding region and the retransform for the succeeding region overlap at an aliasing cancellation portion at the border between the preceding and succeeding regions;

resampling, by interpolation, the retransform for preceding region and/or the retransform for the succeeding region at the aliasing cancellation portion according to a sample rate change at the border; and performing aliasing cancellation between the retransforms for the preceding and succeeding regions as acquired by the resampling at the aliasing cancellation portion so as to reconstruct the information signal in a form sampled at the first sample rate within a portion of the retransform for the preceding region, preceding the aliasing cancellation portion, and sampled at the second sample rate within a portion of the retransform for the succeeding region, succeeding the aliasing cancellation portion.

23. Non-transitory computer-readable medium having stored thereon a computer program comprising a program code for performing, when running on a computer, a method for generating a lapped transform representation of an information signal using an aliasing-causing lapped transform, comprising receiving the information signal in the form of a sequence of samples;

grabbing consecutive, overlapping regions of the information signal;

applying, by interpolation, a resampling onto at least a subset of the consecutive, overlapping regions of the information signals the resampling resulting in each of the consecutive, overlapping portions comprising a respective constant sample rate, with the respective constant sample rate varying among the consecutive, overlapping regions;

applying a windowing on the consecutive, overlapping regions of the information signal; and individually applying a transformation on the windowed regions.

24. Information signal reconstructor according to claim 1, wherein the combiner is configured to perform the aliasing cancellation between the retransforms for the preceding and succeeding regions as acquired by the resampling at the aliasing cancellation portion by arranging the retransforms for the preceding and succeeding regions so as to overlap within the aliasing cancellation portion and adding, for each temporal sample position of the information signal, either a resampled version of the retransform for the preceding region, as acquired by the resampling at the aliasing cancellation portion, with a not-resampled version of the retransform for the succeeding region, or a resampled version of the retransform for the succeeding region, as acquired by the resampling at the aliasing cancellation portion, with a not-resampled version of the retransform for the preceding region.

* * * * *